US008475258B2

(12) United States Patent
Kitamura

(10) Patent No.: US 8,475,258 B2
(45) Date of Patent: Jul. 2, 2013

(54) GAMING MACHINE THAT CAN MOVE CHIP BET TO ANOTHER REGION

(75) Inventor: Kenta Kitamura, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 416 days.

(21) Appl. No.: 12/707,536

(22) Filed: Feb. 17, 2010

(65) Prior Publication Data

US 2010/0190550 A1 Jul. 29, 2010

Related U.S. Application Data

(63) Continuation-in-part of application No. 12/473,650, filed on May 28, 2009, now Pat. No. 8,257,168.

(60) Provisional application No. 61/096,176, filed on Sep. 11, 2008.

(51) Int. Cl.
*A63F 13/06* (2006.01)

(52) U.S. Cl.
USPC ..... 463/17; 463/25; 463/36

(58) Field of Classification Search
USPC ..... 463/25, 30, 17, 36, 37; D21/375
See application file for complete search history.

(56) References Cited

U.S. PATENT DOCUMENTS

| | | | | |
|---|---|---|---|---|
| 5,908,353 | A * | 6/1999 | Andrews | 463/13 |
| 7,311,305 | B2 | 12/2007 | Matsuno et al. | |
| 2002/0090988 | A1* | 7/2002 | Frost et al. | 463/17 |
| 2004/0185933 | A1* | 9/2004 | Nicely | 463/25 |
| 2006/0170154 | A1* | 8/2006 | Matsuno et al. | 273/142 R |

OTHER PUBLICATIONS

U.S. Appl. No. 12/782,260, filed May 18, 2010, Kitamura, et al.

* cited by examiner

*Primary Examiner* — Damon Pierce
(74) *Attorney, Agent, or Firm* — Lexyoume IP Meister, PLLC.

(57) ABSTRACT

A gaming machine is configured so as to have a function of allowing a bet raise operation to be input by a simple operation in a case where a player bets different bet amounts on a plurality of bet regions within a bet time that is time limited. In particular, if a double bet button 81 having been touched by a player is detected, all of the bet amounts stored in memory are changed with one operation by a predetermined multiple, so that players, who decide immediately before the bet time end that they would like to raise, can raise with one operation.

6 Claims, 25 Drawing Sheets

GAMING MACHINE THAT CAN MOVE CHIP BET TO ANOTHER REGION

CROSS-REFERENCE TO RELATED APPLICATIONS

This application is a Continuation-In-Part of U.S. patent application Ser. No. 12/473,650, filed May 28, 2009, which claims the benefit of U.S. Provisional Application No. 61/096,176 filed Sep. 11, 2008. The contents of the above applications are incorporated by reference herein in their entirety.

BACKGROUND OF THE INVENTION

Field of the Invention

The present invention relates to a gaming machine in which an amount of chips bet can easily be raised.

Conventionally, a variety of table games has been known. For example, in a roulette game, firstly, a player places a chip on one or more bet regions among a plurality of bet regions.

Then, a dealer starts rotating a roulette wheel and drops a ball in an outer side of a circumference of a roulette wheel.

Then, the ball rolls along the circumference of the roulette wheel and subsequently drops in a pocket among a plurality of pockets provided on the circumference of the roulette wheel.

Identification numbers from "0" to "36" are assigned to each of the plurality of pockets and, in a case in which a bet region on which a chip is placed corresponds to the identification number assigned to the pocket in which a ball drops, a player can win an award.

Among roulette games, for example, as disclosed in U.S. Pat. No. 7,311,305, a roulette game has been known in which a display for displaying an image is used so as to artificially perform an operation of placing a chip on a bet region.

However, in a gaming machine that artificially performs an operation of placing a chip on a bet region, in a case of raising an amount of chips once placed on a bet region, a bet operation that has already been performed has to be performed again.

More specifically, there has been a problem in that, even in a case in which a player consider to raise a bet amount immediately before a time limit during which the player can place a bet, since it is possible to place a bet on a plurality of bet regions being possible, the player has to perform an input for betting after designating a bet region again, and in a case of placing bets on a plurality of bet regions, a time period for placing bets on each of the plurality of bet regions is insufficient.

It is an object of the present invention to provide a gaming machine which can easily raise an amount of chips bet even immediately before a time limit in which betting is possible.

SUMMARY OF THE INVENTION

In a first aspect of the present invention, a gaming machine includes: a display that displays a game result; a betting board that has a plurality of bet regions corresponding to a plurality of types of the game results, and allows betting different bet amounts on a plurality of the bet regions in one game; an input device that allows a plurality of locations of the plurality of bet regions on the betting board to be designated, and allows a bet amount related to the plurality of bet regions thus designated to be input at a different bet amount for each of the bet regions thus designated; memory that stores each of the bet amounts on the plurality of bet regions designated by way of the input device; a raise switch for raising a bet amount previously bet on each of the plurality of bet regions at a predetermined multiple; a timer for measuring a bet time in which the input device and the raise switch can be operated; and a controller that executes processing of: (a) setting a bet time according to start of a game, and measuring the bet time in the timer; (b) designating at least one bet region from among the plurality of bet regions on the betting board, and receiving input of a bet amount on each of the at least one bet region by way of an operation of the input device; (c) associating the bet amount input by way of the input device respectively with the at least one bet region designated, and storing thereof in the memory; (d) converting all of the bet amounts of at least 0 stored and associated with the at least one bet region stored in the memory to a predetermined multiple simultaneously in response to an input of the raise switch; (e) ending the bet time in response to a time measured by the timer having passed a time set in advance, and rejecting a bet input by way of the input device and an input of the raise processing by way of the raise switch; and (f) displaying a game result on the display after the processing of (e).

The first aspect of the present invention is preferably applied to a game, such as a roulette game, in which (i) a bet time is limited, (ii) a bet can be placed on a plurality of bet regions, and (iii) in addition, different bet amounts can be placed on the plurality of bet regions.

According to the first aspect of the present invention, since the bet amount of the plurality of bet regions, previously stored in the memory, can be raised with one operation at a predetermined multiple, a concern over a time duration for betting being short can be reduced, even immediately before a time limit for betting.

In a second aspect of the present invention, a gaming machine includes: a display that displays a game result; a betting board that has a plurality of bet regions corresponding to a plurality of types of the game results, and allows betting different bet amounts on a plurality of the bet regions in one game; an input device that allows a plurality of locations of the plurality of bet regions on the betting board to be designated, and allows a bet amount related to the plurality of bet regions thus designated to be input at a different bet amount for each of the bet regions thus designated; memory that stores each of the bet amounts on the plurality of bet regions designated by way of the input device; a timer for measuring a bet time in which the input device can be operated; and a controller that executes processing of: (a) setting a bet time according to start of a game, and measuring the bet time in the timer: (b) designating at least one bet region from among the plurality of bet regions on the betting board, and receiving input of a bet amount on each of the at least one bet region by way of an operation of the input device; (c) associating the bet amount input by way of the input device respectively with the at least one bet region designated, and storing in the memory; (d') performing raise processing for the bet amounts of at least 0 stored and associated with the at least one bet region stored in the memory in response to re-input on the input device and updating the bet amounts stored in the memory; (e) ending the bet time in response to a time measured by the timer having passed a time set in advance, and rejecting a bet input by way of the input device; and (f) displaying a game result on the display after the processing of (e).

According to the second aspect of the present invention, since the input device for inputting the bet amount is operated continuously for a short time period after designating the bet regions and the present input device can be operated continuously for a short time period after designating another bet region, it becomes possible to make many bets quickly on the plurality of bet regions.

In a third aspect of the present invention, a gaming machine includes: a display that displays a game result; a betting board that has a plurality of bet regions corresponding to a plurality of types of the game results, and allows betting different bet amounts on a plurality of the bet regions in one game; an input device that allows a plurality of locations of the plurality of bet regions on the betting board to be designated, and allows a bet amount related to the plurality of bet regions thus designated to be input at a different bet amount for each of the bet regions thus designated; memory that stores each of the bet amounts on the plurality of bet regions designated by way of the input device; a timer for measuring abet time in which the input device can be operated; and a controller that executes processing of: (a) setting a bet time according to start of a game, and measuring the bet time in the timer: (b) designating at least one bet region from among the plurality of bet regions on the betting board, and receiving input of abet amount on each of the at least one bet region by way of an operation of the input device; (c') raising values of the bet amounts input by way of the input device according to a number of times the input device is operated, associating respectively with the at least one bet region, and storing thereof in the memory; (e) ending the bet time in response to a time measured by the timer having passed a time set in advance, and rejecting a bet input by way of the input device; and (f) displaying a game result on the display after the processing of (e).

According to the third aspect of the present invention, since the value of the bet amounts that are input once can be easily raised by operating the input device repeatedly, it becomes possible to make many bets quickly on the plurality of bet regions.

DETAILED DESCRIPTION OF THE INVENTION

Figure 1:
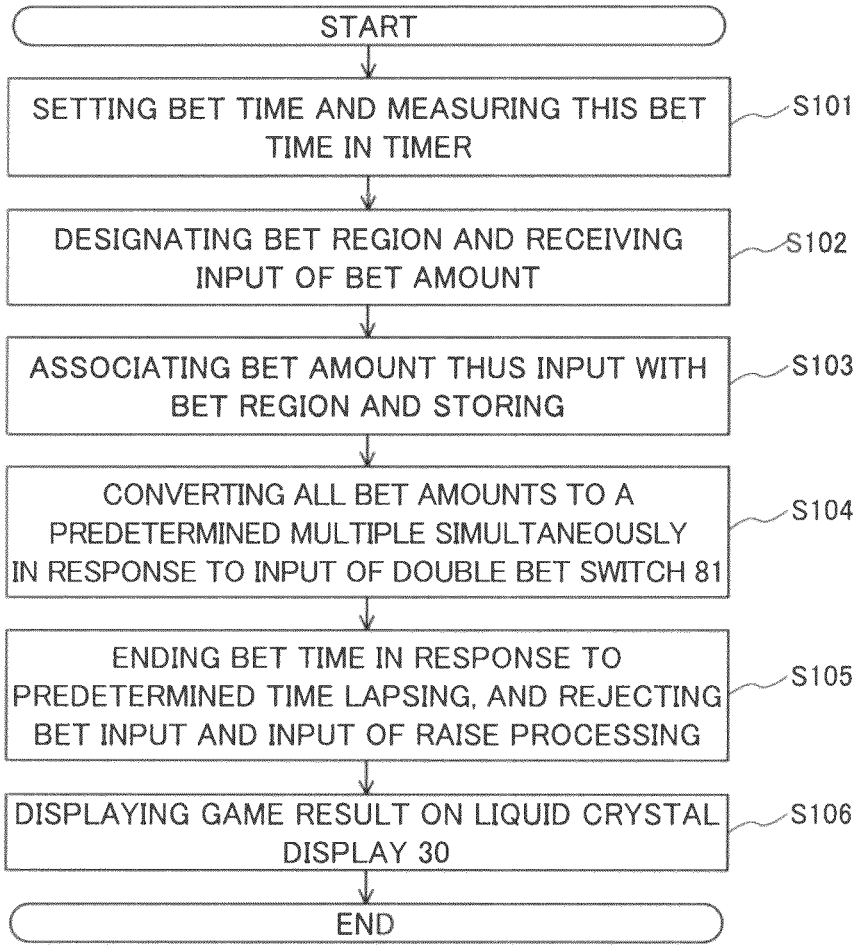
FIG. 1 is a flowchart schematically showing bet processing and raise processing executed in a gaming machine according to a first embodiment of the present invention.

A first embodiment of the present invention is described below with reference to the accompanying drawings.

As described in detail later, a gaming machine 13 according to the present invention includes: includes a liquid crystal display 30 that displays game results; a betting board 70 that has a plurality of bet regions 71 and 73, and allows for different bet amounts to be bet on a plurality of bet regions in one game; a input device that allows a plurality of locations of the plurality of bet regions 71 and 72 on the betting board 70 to be designated, and allows for the bet amounts on the plurality of bet regions thus designated to be input at different bet amounts on each bet region thus designated (e.g., touch panel 32, unit bet button 76); RAM 110 in which each bet amount of the plurality of bet regions thus designated by way of the input device is stored; a raise switch (for example, a double bet button 81) for raising a bet amount that had been previously bet on each of the plurality of bet regions 71, 72 by a predetermined multiple; a timer 113 for measuring a bet time in which the input device and the raise switch can be operated; and a CPU 106 that executes subsequent bet processing and raise processing.

As shown in FIG. 1, the CPU 106 sets a bet time according to the start of a game, and measures this bet time in the timer 113 (Step S101).

Then, the CPU 106 designates at least one bet region from among the plurality of bet regions 71 and 72 displayed on the betting board 70, and receives an input of a bet amount on each of the at least one bet regions byway of operation of the input device (Step S102).

Then, the CPU 106 associates a bet amount thus input by way of the input device with each of the at least one bet regions thus designated, and stores in the RAM 110 (Step S103).

Then, the CPU 106 converts all of the bet amounts of at least 0 stored and associated with the at least one bet regions 71 and 72 stored in the RAM 110 to a predetermined multiple simultaneously in response to an input of the double bet button 81 (Step S104).

Then, the CPU 106 ends the bet time in response to a time measured by the timer 113 having passed a time set in advance (for example, 30 seconds), and rejects a bet input by way of the input device and an input of the double bet button 81 (Step S105).

Then, the CPU 106 displays a game result on the liquid crystal display 30 (Step S106).

In response to the processing of Step S106, the CPU 106 ends the bet processing and raise processing.

It should be noted that, although the double bet button 81 is provided in the present embodiment, as shown in the embodiment described above, the unit bet button 76 may be configured to be controlled so as to have the similar functions as the double bet button 81 X seconds immediately before the end time of the bet time period.

With this configuration, by the CPU 106 controlling with a program, so that raise amount ratios become larger and larger as the bet time end becomes closer, a similar configuration can be realized using a single button switch without being structurally complicated.

In addition, the bet button 76 and the double bet button 81 can be configured with physical switches, without virtual switches that employ a touch panel.

Figure 2:
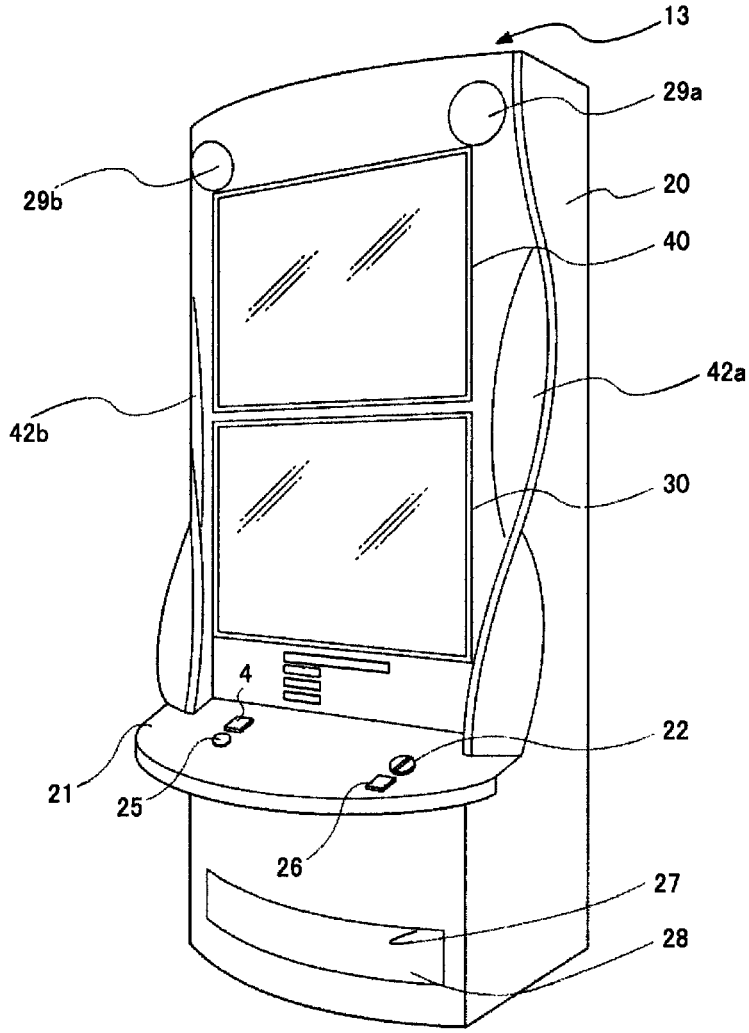
FIG. 2 is a perspective view of a gaming machine according to first and second embodiments of the present invention.

FIG. 2 is a perspective view showing the gaming machine 13 according to an embodiment of the present invention.

The gaming machine 13 includes a cabinet 20.

A face of the cabinet 20 that faces the player is opened.

The cabinet 20 contains various components including a game controller 100 (refer to FIG. 3) for electrically controlling the gaming machine 13, and a hopper 44 (refer to FIG. 5) for controlling the insertion, storage, and payout of coins (game medium), and the like.

The game medium is not limited to coins and medals, tokens, electronic money or electronic value information (credit) corresponding to these, for example, can be exemplified as the game medium.

The liquid crystal display 30 is installed substantially in the middle of the front face of the cabinet 20, and the liquid crystal display 40 is installed in an upper side of the cabinet 20.

The liquid crystal display 30 realizes a display device for displaying a variety of images related to the game including rendered images and the like.

Such a configuration allows the player to advance the game while visually confirming various kinds of images displayed on the aforementioned liquid crystal display 30.

Figure 14:
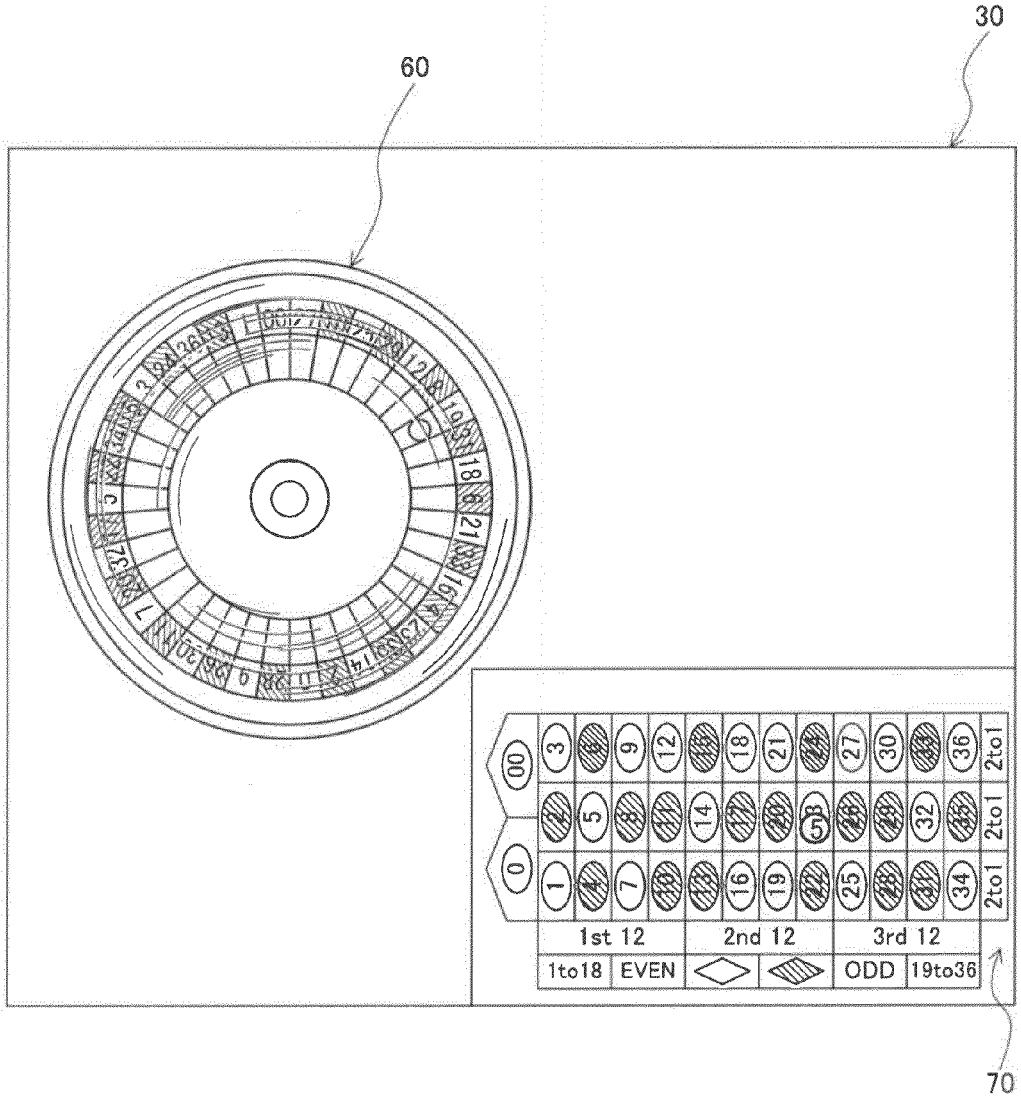
FIG. 14 is a view showing an example of a display screen of a roulette game displayed in a gaming machine according to the first and second embodiments of the present invention.

For example, the liquid crystal display 30 displays a roulette game as shown in FIG. 14 described later.

The other liquid crystal display 40, which is above the liquid crystal display 30, is a display functioning as a sub display for displaying the rules of the game, demonstration screens, and the like.

Sound transmission openings 29*a* and 29*b* are provided to both upper left and right sides of the liquid crystal display 40 in order to transmit sound effects generated by a speaker 41 (see FIG. 3) stored within the cabinet 20.

The sound transmission openings 29*a* and 29*b* generate sound effects and the like in accordance with the progress of the game.

In addition, decorative lamps 42*a* and 42*b* are disposed on the right and left sides substantially in the middle of the gaming machine 13, respectively.

The decorative lamps 42*a* and 42*b* emit light in accordance with the progress of the game.

The gaming machine 13 includes a substantially horizontal operation unit 21 below the liquid crystal display 30.

A coin insertion slot 22, which is for inserting coins into the gaming machine 13, is provided on the right side of the operation portion 21.

On the other hand, a start switch 25 that accepts a player's operation for starting a game for each game is disposed on the left side of the operation portion 21.

A pushing operation on the start switch 25 triggers a roulette game.

Furthermore, a cash-out switch 26 is provided near the coin insertion opening 22.

Upon the player pushing the cash-out switch 26, the inserted coins are paid out from a coin payout opening 27 provided at a lower portion of the front face. The coins thus paid out are retained in a coin tray 28.

Figure 3:
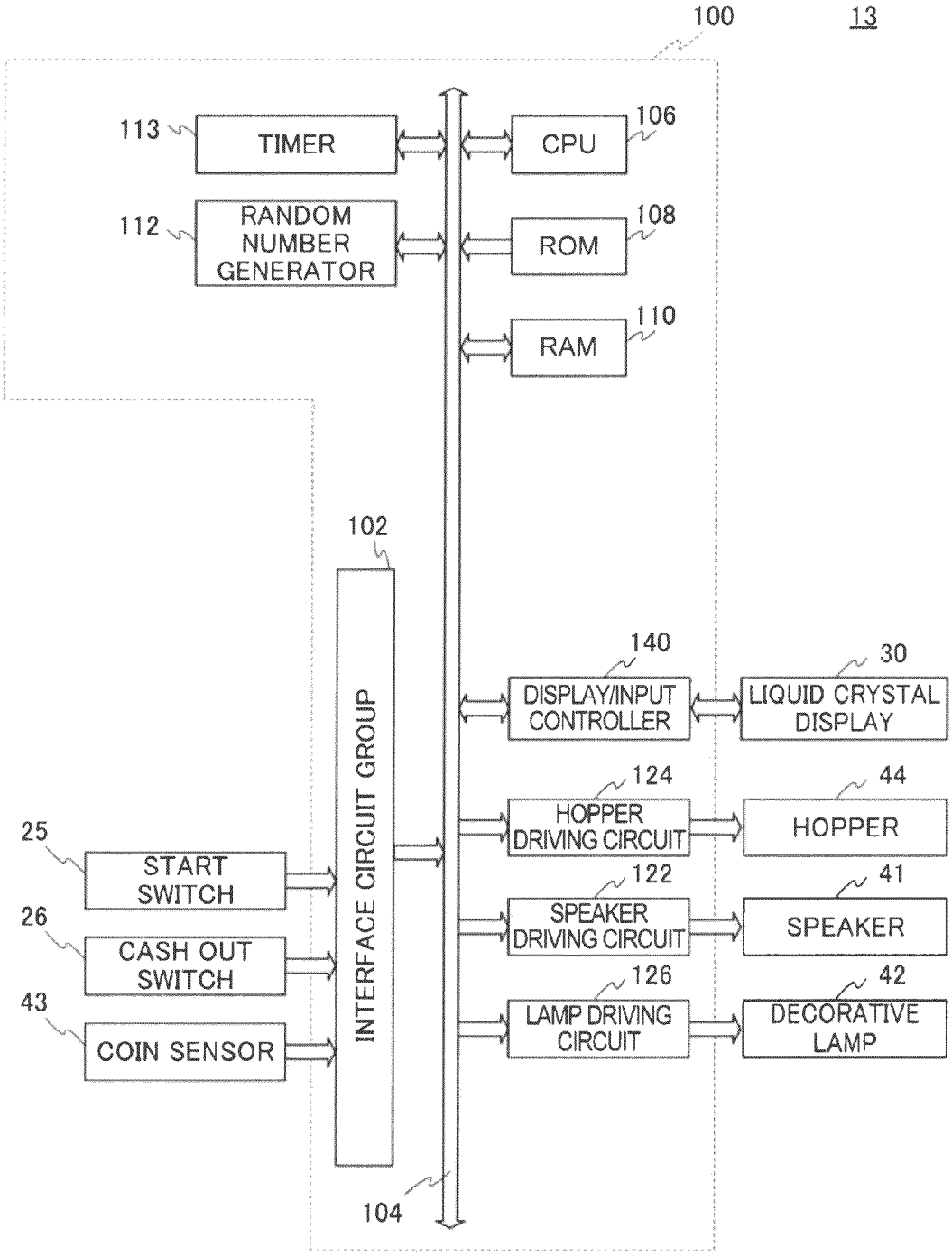
FIG. 3 is a block diagram showing an internal configuration of the gaming machine in FIG. 2.

FIG. 3 is a block diagram showing the electrical configuration of the game controller 100 of the gaming machine 13.

As shown in FIG. 3, the game controller 100 of the gaming machine 13 is a microcomputer provided with an interface circuit group 102, an input-output bus 104, a CPU 106, ROM 108, RAM 110, a random number generator 112, a timer 113, a speaker driving circuit 122, a hopper driving circuit 124, a lamp driving circuit 126, and a display/input controller 140.

The interface circuit group 102 is electrically connected with the input/output bus 104, which carries out input and output of data signals or address signals for the CPU 106.

The start switch 25 is electrically connected with the interface circuit group 102.

In the interface circuit group 102, a start signal generated by the start switch 25 is converted into a predetermined form of signal to be supplied to the input/output bus 104.

The cash-out switch 26 is electrically connected with the interface circuit group 102.

The switching signal outputted from this cash-out switch 26 is also supplied to the interface circuit group 102, and is converted into a predetermined signal by the interface circuit group 102.

The switching signals thus converted are supplied to the input/output bus 104.

A coin sensor 43 is also electrically connected to the interface circuit group 102.

The coin sensor 43 is a sensor for detecting coins that have been inserted into the coin insertion slot 22, and is disposed at an appropriate position relative to the coin insertion slot 22.

The sensing signal output from the coin sensor 43 is also supplied to the interface circuit group 102, and after converting thereof into a predetermined signal by the interface circuit group 102, is supplied to the input/output bus 104.

The CPU 106, the ROM 108, and the RAM 110 are connected to the input-output bus 104.

Upon accepting the start operation of a game through the start switch 25, the CPU 106 reads a game program to execute the game.

The game program displays a bet screen (described later in FIGS. 9 to 13) on the liquid crystal display 30 through the display/input controller 140 and allows the player to designate a bet region and bet number.

Upon completing the designation, an image of a roulette wheel rotating (described later in FIG. 14) is displayed on the liquid crystal display 30.

Figure 5:
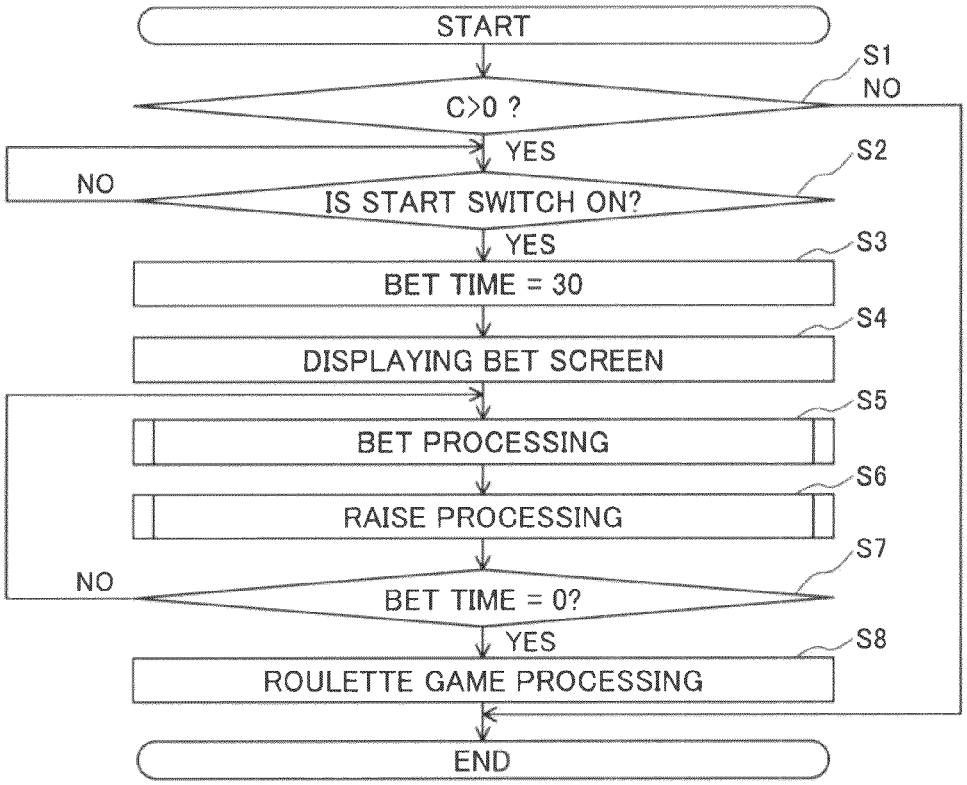
FIG. 5 is a flowchart of a control program for overall control of a gaming machine according to first and second embodiments of the present invention.
Figure 6:
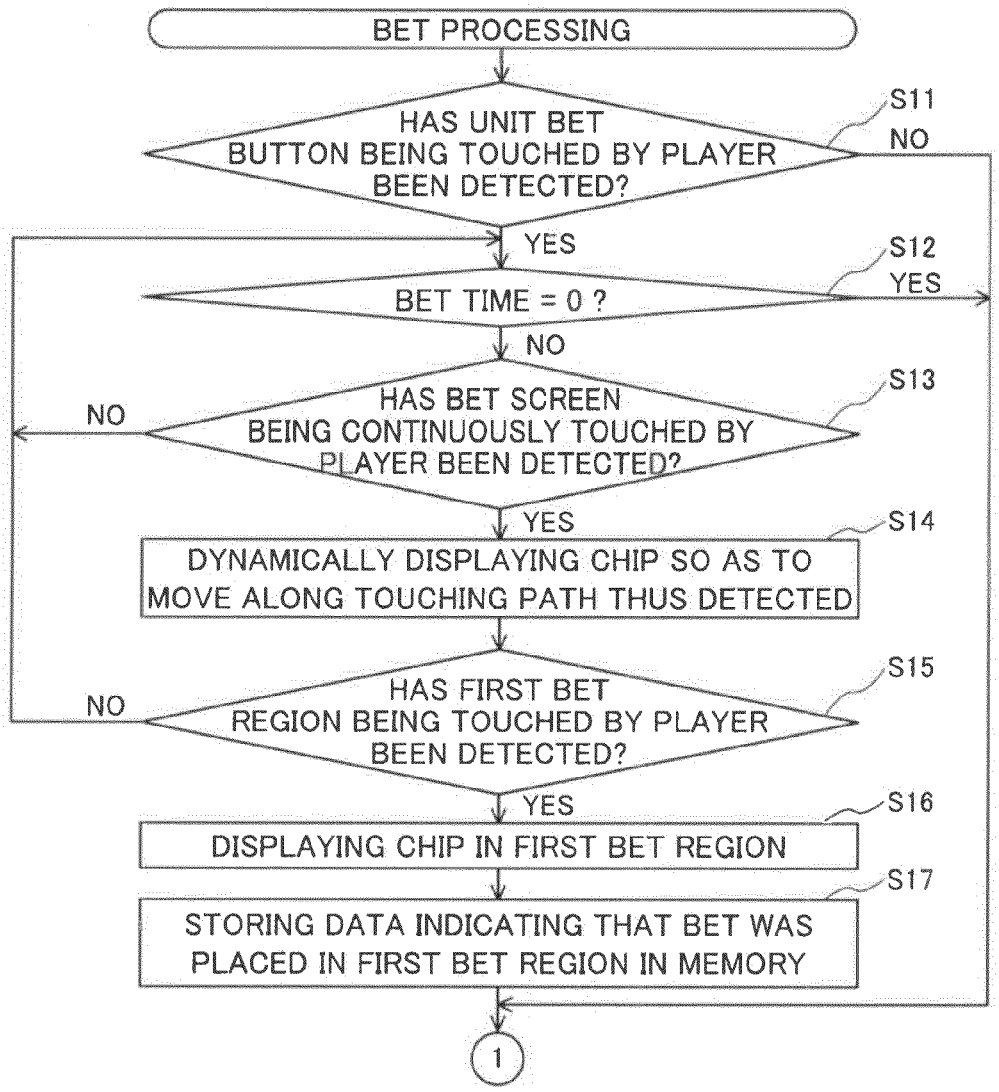
FIGS. 6 and 7 are flowcharts showing bet processing which is one routine execution program executed in a gaming machine according to first and second embodiments of the present invention.
Figure 8:
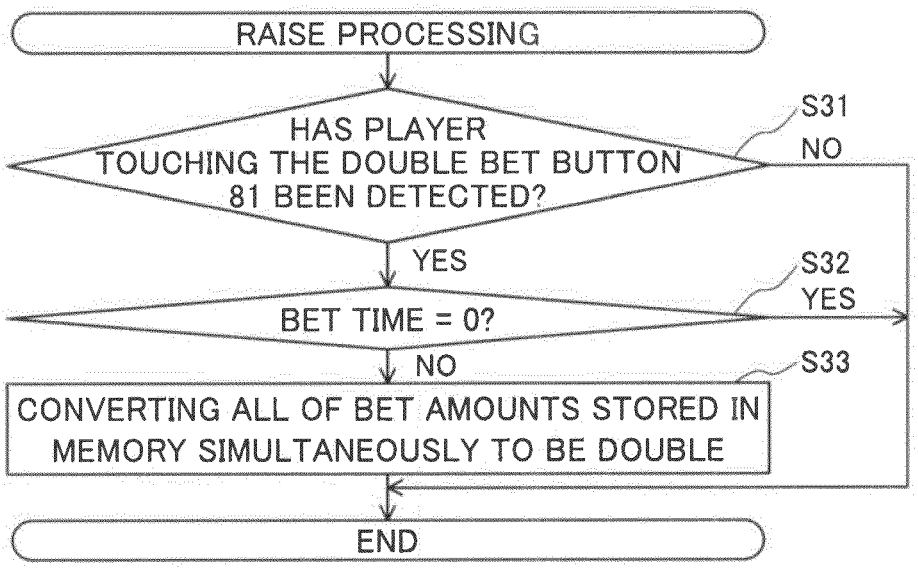
FIG. 8 is a flowchart of raise processing, which is one of the routine execution programs executed in a gaming machine according to the first embodiment of the present invention.

The ROM 108 stores a control program for governing and controlling the gaming machine 13 (described later in FIG. 5), a program for executing routines as shown in FIGS. 6 and 8 (hereinafter referred to as a "routine execution program"), and initial data for executing the control program, and various data tables used in determination processes.

The RAM 110 temporarily stores flags, variables, etc. used for the aforementioned control program.

The random number generator 112 for generating a random number is connected to the input/output bus 104.

The random number generator 112 generates random numbers in a predetermined range of "0" to "65535" (the sixteenth power of two minus one), for example.

Alternatively, an arrangement may be made in which the CPU 106 generates a random number by computation.

A timer 113 is also connected to the input/output bus 144.

The timer 113 measures the amount of time after starting acceptance of a bet.

More specifically, the timer 113 measures an elapsed time after the CPU 106 displays a bet screen on the liquid crystal display 30.

In the present embodiment, the CPU 106 ends accepting a bet when 30 seconds lapse after displaying a bet screen, and displays an image of a roulette wheel rotating on the liquid crystal display 30.

The speaker driving circuit 122 for driving the speakers 41 is also electrically connected with the input/output bus 104.

The CPU 106 reads the sound data stored in the ROM 108, and transmits the sound data thus read to the speaker driving circuit 122 via the input/output bus 104.

In this way, the speakers 41 generate predetermined sound effects.

The hopper driving circuit 124 for driving the hopper 44 is also electrically connected to the input/output bus 104.

Upon receiving a cash-out signal input from the cash-out switch 26, the CPU 106 transmits a driving signal to the hopper driving circuit 124 via the input/output bus 104.

Accordingly, the hopper 44 pays out coins such that the amount thereof is equivalent to the current number of coins remaining as credits, which is stored in a predetermined memory area of the RAM 110.

Alternatively, the payout of the coins may be performed in the form of credit data stored in a data card or the like, instead of using physical coins.

That is, the player may carry a card functioning as a recording medium, and store the data related to the credit by inserting the card into the gaming machine 13.

The lamp driving circuit 126 for driving the decorative lamps 42*a* and 42*b* is also connected with the input/output bus 104.

The CPU 106 transmits the signal for driving the lamps according to the predetermined conditions based on the program stored in the ROM 108 to the lamp driving circuit 126.

Thus, decorative lamps 42*a* and 42*b* blink and the like.

The display/input controller 140 is also connected to the input/output controller 140.

The CPU 106 creates an image display command corresponding to the state and results of the game, and outputs the image display command thus created to the display/input controller 140 via the input/output bus 104.

Upon receiving the image display command input from the CPU 106, the display/input controller 140 creates a driving signal for driving the liquid crystal display 30 according to the image display command thus input, and outputs the driving signal thus created to the liquid crystal display 30.

As a result, a predetermined image is displayed on the liquid crystal display 30.

The display/input controller 140 transmits the signal, which is an input received by the touch panel 32 on the liquid crystal display 30, to the CPU 106 via the input/output bus 104 in the form of an input signal.

Figure 4:
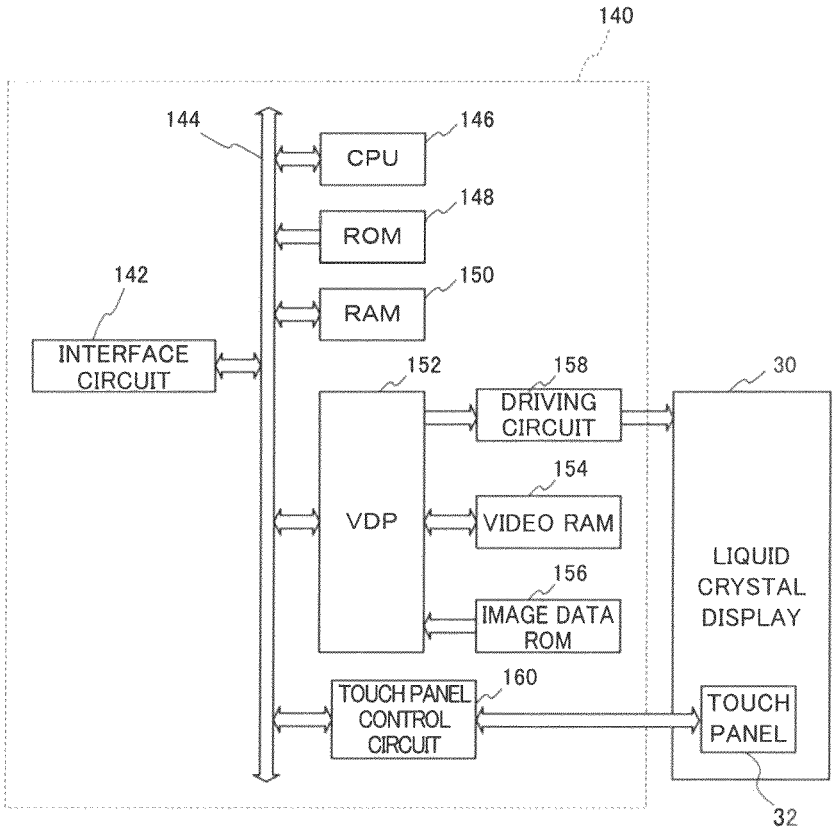
FIG. 4 is a block diagram showing an internal configuration of a display/input controller in the gaming machine shown in FIG. 2.

FIG. 4 is a block diagram showing the electrical configuration of the display/input controller 140 of the gaming machine 13.

The display/input controller 140 of the gaming machine 13 is a sub-micro computer which performs image display processing and the control of input from the touch panel 32, and has an interface circuit 142, an input/output bus 144, CPU 146, ROM 148, RAM 150, VDP 152, video RAM 154, ROM 156 for image data, a driving circuit 158, and a touch panel control circuit 160.

The interface circuit 142 is connected to the input/output bus 144.

An image display instruction outputted from the CPU 106 on the abovementioned game controller 100 is supplied to the input/output bus 144 via the interface circuit 142.

The input/output bus 144 performs input/output of data signals or address signals with the CPU 146.

The ROM 148 and the RAM 150 are connected to the input/output bus 144.

The ROM 148 stores a display control program for generating the drive signal to be supplied to the liquid crystal display 30, based on the image display command from the CPU 106 on the game controller 100.

On the other hand, the RAM 150 stores flags and variables used in the aforementioned display control program.

The VDP 152 is connected to the input/output bus 144.

The VDP 152 includes a so-called sprite circuit, a screen circuit, a palette circuit, etc., and can perform various kinds of processing for displaying images on the liquid crystal display 30.

The video RAM 154 and the ROM 156 are connected to the VDP 152.

The video RAM 154 stores image data based on the image display instructions from the CPU 106 on the game controller 100. The ROM 156 for image data stores various kinds of image data containing the abovementioned produced image data.

Furthermore, the driving circuit 158 for outputting a driving signal for driving the liquid crystal display 30 is connected to the VDP 152.

The CPU 146 reads and executes the display control program stored in the ROM 148, whereby the video RAM 154 stores image data to be displayed on the liquid crystal display 30 in response to the image display command from the CPU 106 on the game controller 100.

Examples of the image display commands include various kinds of image display commands including the aforementioned image display commands for visual effects, etc.

The image data ROM 156 stores various kinds of image data including the aforementioned image data for visual effects, etc.

The touch panel control circuit 160 transmits the signals, which are inputs received by the touch panel 32 on the liquid crystal display 30, to the CPU 106 via the input/output bus 144 in the form of an input signal.

FIG. 5 is a flowchart, which shows a flow of the processing operation of the gaming machine 13, is executed by the game controller 100 of the gaming machine 13.

The processing operation is called from a main program for the slot machine 13 at a predetermined timing, and then executed.

In the following, supposing that the gaming machine 13 is activated in advance and the variables used in the CPU 106 on the game controller 100 are initialized to predetermined values, respectively, the gaming machine 13, as a result of this, will be operating normally.

Firstly, the CPU 106 on the game controller 100 determines whether any credits, which correspond to the remaining amount of coins inserted by the player, remain (Step S1). More specifically, the CPU 106 reads the amount of credits C stored in the RAM 110, and executes processing according to the amount of credits C.

When the amount of credits C equals "0" (a NO determination in Step S1), the CPU 106 terminates the routine without executing any processing, since it cannot start a game.

When the amount of credits C is not less than "1" (a YES determination in Step S1), the CPU 106 determines that coins remain as credits, and the CPU 106 advances the processing to Step S2.

In Step S2, the CPU 106 determines whether the start switch 25 is ON, and waits for the start switch 25 to be operated.

Upon the start switch 25 being operated, and accordingly, upon an operation signal being input from the start switch 25 (in a case of a YES determination in Step S2), the CPU 106 determines that the start switch 25 has been operated, and advances the processing to Step S3.

In Step S3, the CPU 106 sets the bet time to "30" by setting the timer 113 to "30".

The timer 113 decrements by "1" with every 1 second that elapses. In Step S4, the CPU 106 displays a bet screen (see FIGS. 9 to 13) on the liquid crystal display 30.

In Step S5, the CPU 106 performs bet processing, which is described later with reference to FIGS. 6 and 7.

In Step S6, the CPU 106 performs raise processing, which is explained later with reference to FIG. 8.

In Step S7, the CPU 106 determines whether the bet time is "0" or not by determining whether the timer 113 is "0" or not.

Along with this, in a case in which the CPU 106 determines that the bet time is "0" (in a case of a YES determination in the processing of Step S7), the CPU 106 rejects bet processing and raise processing, performs roulette game processing (Step S8) and ends the present routine.

For example, as shown in FIG. 14, in the roulette game processing, the CPU 106 displays an image in which a roulette game is performed on the liquid crystal display 30.

On the other hand, in a case in which the CPU 106 determines that the bet time is not "0" (in a case of a NO determination in the processing of Step S7), the CPU 106 returns the processing to Step S5.

Figure 7:
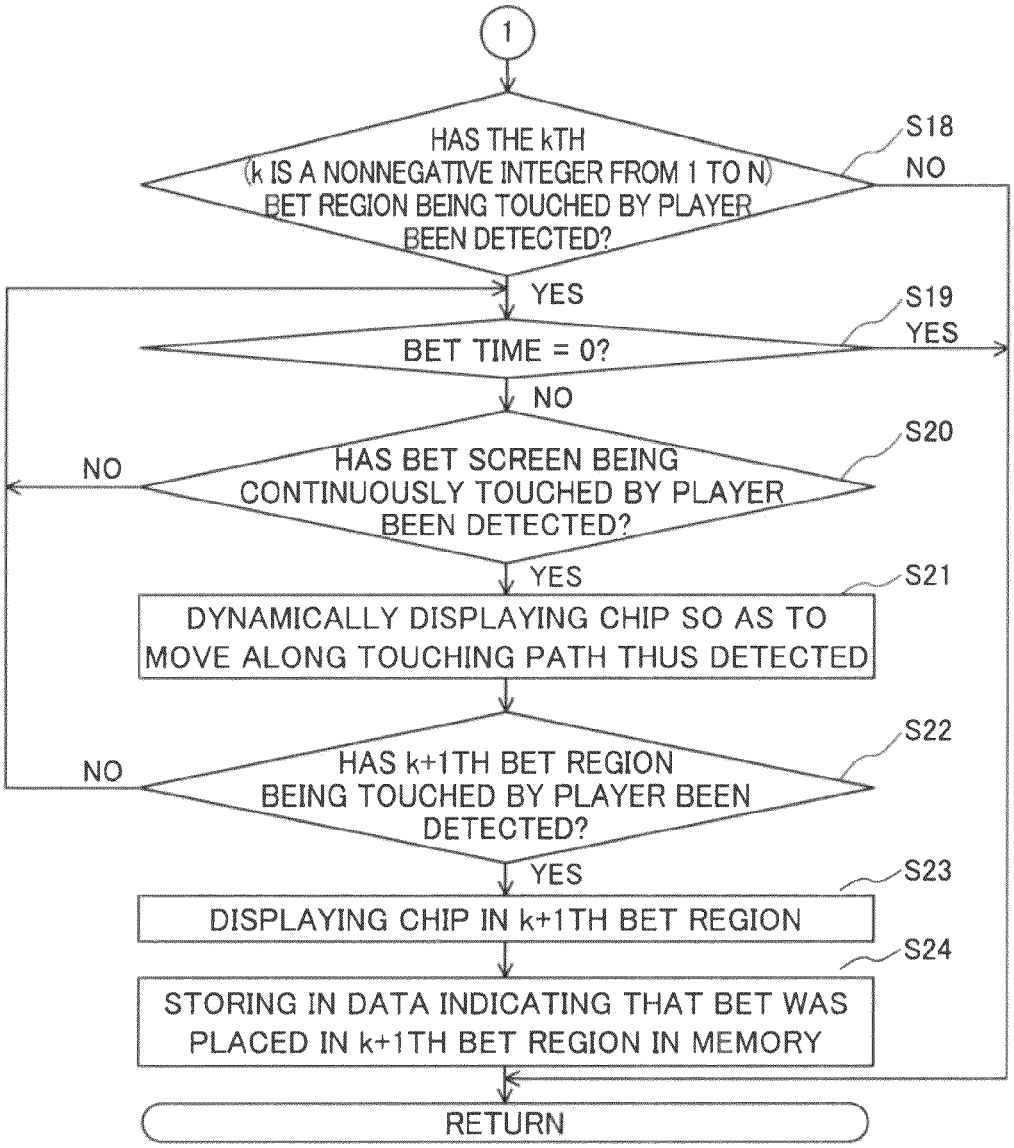

FIGS. 6 and 7 are flowcharts showing flows of bet processing.

A bet screen according to an embodiment of the present invention is described with reference to FIG. 9, which illustrates a flow of bet processing.

Figure 9:
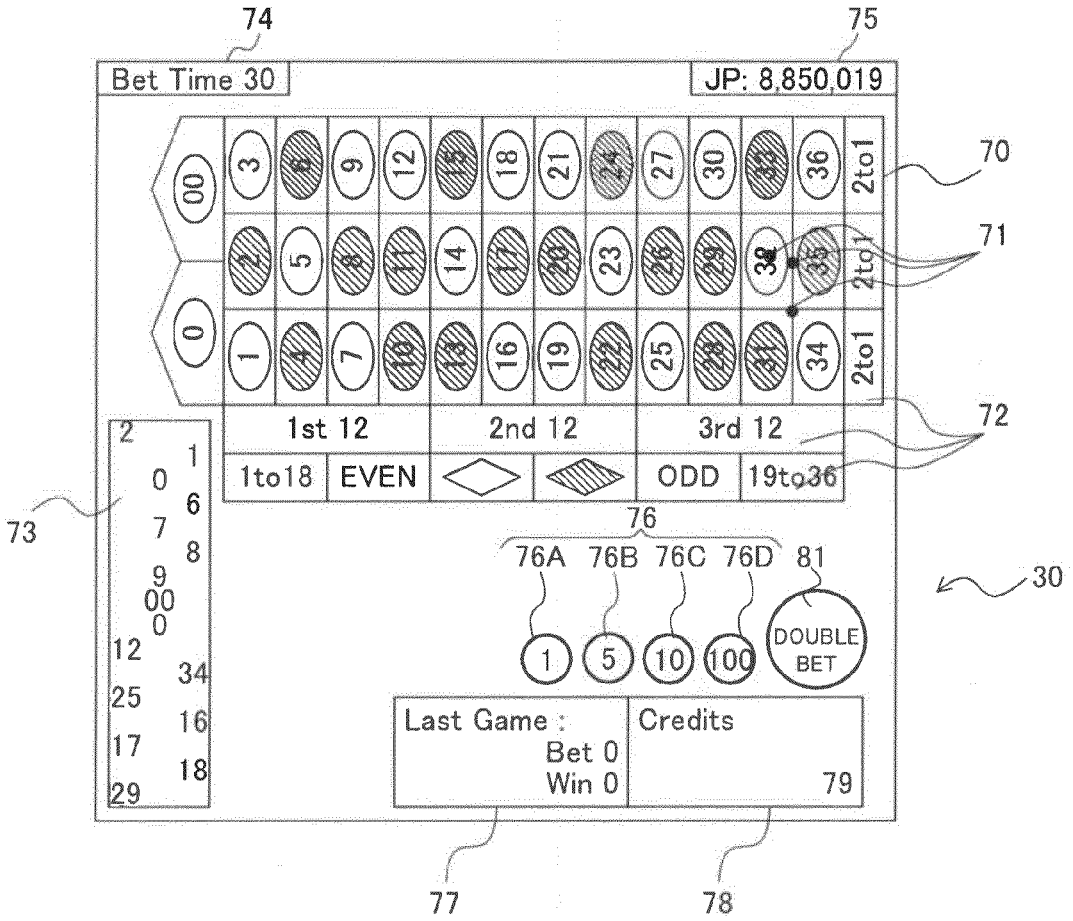
FIGS. 9 to 13 are views showing an example of a bet screen displayed in a gaming machine according to the first embodiment of the present invention.

FIG. 9 is an enlarged view of a display region in the liquid crystal display 30 of the gaming machine 13.

In the liquid crystal display 30, a betting board 70 is displayed.

A plurality of bet regions 71 for betting credits is displayed on the betting board 70.

In the bet regions 71, 38 numerals of "0", "00", and "1" through "36" are aligned and displayed in boxes.

For example, as shown in FIG. 9, in a case in which a chip is placed on a box "32", betting a chip on a single number "32" is indicated.

Such a betting method is called "Straight-up bet".

Furthermore, in a case in which a chip is placed on a line between boxes "32" and "35", betting a chip on two numbers "32" and "35" is indicated.

Such a betting method is called a "Split-bet".

In a case in which a chip is placed at the intersection of the lines between the boxes "31", "32", "34", and "35", betting a chip on four numbers "31", "32", "34", and "35".

Such a betting method is called a "Corner-bet".

Furthermore, special bet regions 72, which allow a player to bet on "even numbers", "odd numbers", "the color of the numbers display plate 64 (red or black)", "a predetermined range of numbers (e.g., "1" to "12")", are arranged similarly in a grid form.

For example, in a case in which a chip is placed at a box in which "EVEN" is depicted, this indicates that a chip is bet on even number.

Such a betting method is called "Even".

Furthermore, in a case in which a chip is placed at a box in which "ODD" is depicted, this indicates that a chip is bet on odd number.

Such a betting method is called "Odd".

Furthermore, in a case in which a chip is placed at a box in which red diamond is depicted, betting a chip on boxes with a red color is indicated.

Such a betting method is called "Red".

In a case in which a chip is placed in a box in which black color diamond is depicted, betting a chip so as to cover boxes with a black color is indicated.

Such a betting method is called "Black".

In a case in which a chip is placed in a box in which "1st 12", "2nd 12", or "3rd 12" is depicted, betting a chip so as to cover 12 numbers is indicated, respectively.

Such a betting method is called "Dozen Bets".

In a case in which a chip is placed in a box in which "1 to 18" or "19 to 36" is written, betting a chip so as to cover 18 numbers according to whether the number is no more than 18 or at least 19 is indicated.

Such a betting method is called "1 to 18/19 to 36".

In a case in which a chip is placed in a box in which "2 to 1" is written, betting a chip so as to cover 12 numbers of each column including numbers such as "1", "4", "7" . . . is indicated.

Such a betting method is called "Column bet".

Other bet methods are "Street bet", which places a bet on the end of a horizontal row of number so as to cover 3 numbers (e.g., "13", "14", and "15"); "Five bet", which places a bet on a line between the numbers "00" and "3" so as to cover the five numbers "0", "00", "1", "2", and "3"; and "Line bet", which places a bet between two horizontal rows of numbers so as to cover 6 numbers (e.g., "13", "14", "15", "16", "17", and "18").

The abovementioned bet methods have awarded credits per one chip when a chip bet has won (payout rate) that are respectively different.

A result history display unit 73 is displayed on the left side of the betting board 70.

The result history display unit 73 displays the results of the winning numbers of the past games up to the previous game in the form of a list. The term "one game" as used here represents a series of operations from a stage in which the player places a bet in the gaming machine 13, up to a stage in which the player plays a roulette game.

With such an arrangement, upon completion of one game, a new winning number is added to the top field of the list, which has a capacity to allow the players to confirm the history of the winning numbers of a maximum of 16 games.

A bet time display unit 74 is provided at an upper portion of the betting board 70.

The bet time display unit 74 displays time remaining during which the player can place bets. For example, the bet time display unit 74 displays the time remaining "30" at the start time for receiving bets. Then, the time remaining displayed by the bet time display unit 74 is reduced in decrements of 1 for each second. Upon the time remaining becoming zero, the period for receiving bets expires.

Furthermore, a JP (Jack Pot) display unit 75 for displaying the amount of credits accumulated up to the current point in time is provided on the right side of the bet time display unit 74.

Here, the JP display unit 75 displays the amount of credits obtained as 0.5% of the accumulated credits up to the previous game.

In the case that a predetermined condition has been satisfied in a jackpot bonus game that occurs at a certain timing, the player wins in the jackpot bonus game, and the credit amount for the jackpot is paid out, whereupon the JP display unit 75 displays an initial value (e.g., 50,000 credits) after the payout.

Unit bet buttons 76 are provided at the lower part of the betting board 70.

The bet unit buttons 76 are provided for allowing the player to place bets using chips on the bet regions 71 and 72 (a box having a number and mark, or a line which defines the boxes) specified by the player.

The bet button 76 is composed of a 1 bet button 76A, a 5 bet button 76B, a 10 bet button 76C, and a 100 bet button 76D.

A player can bet chips by pushing any one of the unit bet buttons 76 directly such as by a finger, and continuously pushing the unit bet button 76 until a bet region 71 or 72 where the player wants to bet.

The present invention is not restricted to such an arrangement in which the chips are bet on one location.

After pushing any one of the unit bet buttons 76, by continuing to push the unit bet button 76 until a bet region 71 or 72 where the player wants to bet, a plurality of bet operations becomes possible.

A payout number display unit 77 is provided at a lower part of the unit bet buttons 76.

The payout number display unit 77 displays the amount of chips bet in the previous game and the number of credits paid out.

Here, a number obtained by subtracting the amount bet from the number of credits paid out is the number of credits which the player has newly acquired by the previous game.

This display example shows a day's first instance of a roulette game in the gaming machine 13, so the amount bet and the payout credits both show "0".

Furthermore, a credit amount display unit 78 is provided at the right side of the payout number display unit 77.

A credit amount display unit 78 displays the amount of credits which the player currently has.

This credit amount decreases as chips are bet (one credit for one bet).

In addition, in a case where a chip bet has won, and pay out of credits is done, a number of credits of a paid out amount is added.

It should be noted that, in the event that the number of credits which the player has becomes zero, the game is over.

In this display example, "79" is displayed as the credit amount .

With reference to FIGS. 6 and 7 again, a flowchart showing a flow of bet processing is described.

Firstly, the CPU 106 determines whether any one of the unit bet buttons 76 being touched by the player has been detected (Step S11).

In a case in which any one of the unit bet buttons 76 has been detected being touched by the player (in a case of a "YES" determination in Step S11), the CPU 106 advances the processing to Step S12.

Figure 18:
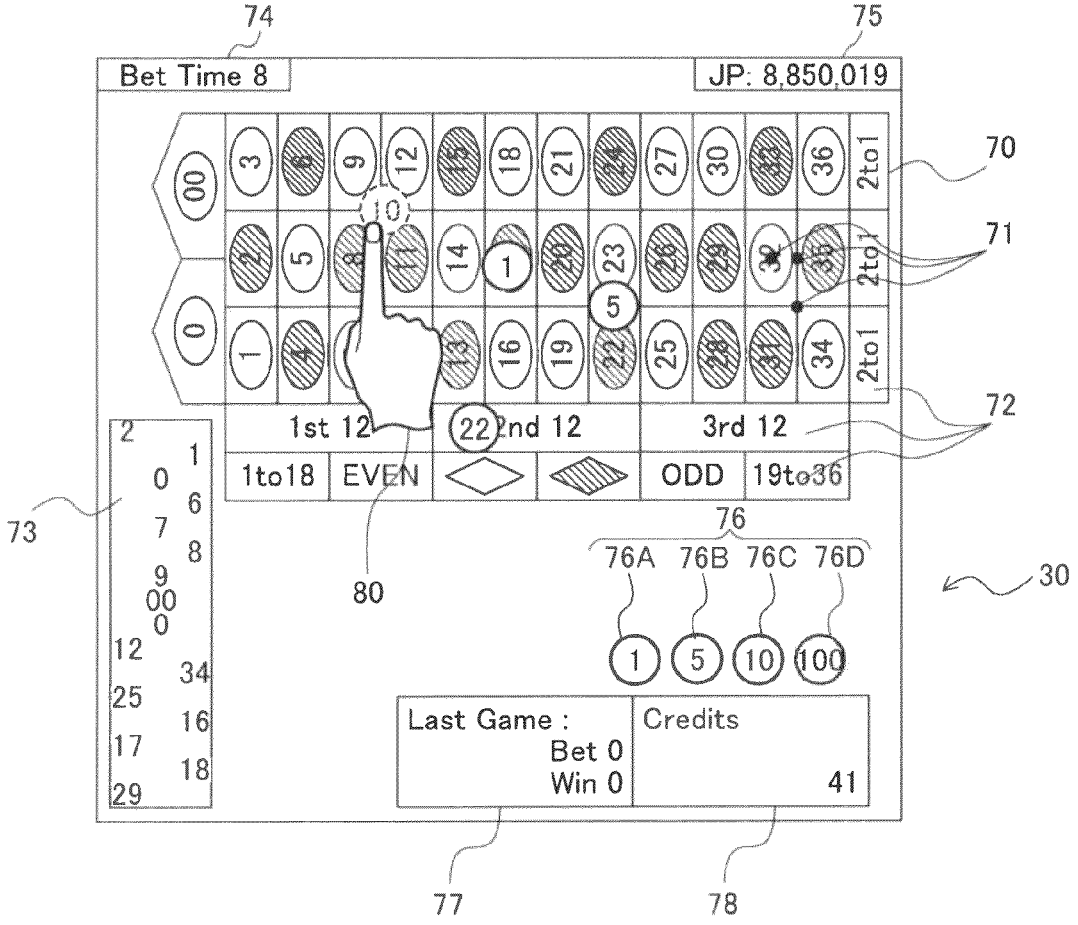

On the other hand, in a case in which any one of the unit bet buttons 76 has not been detected being touched by the player (in the case of a "NO" determination in Step S11), the CPU 106 advances the processing to Step S18 of FIG. 18.

In Step 512, the CPU 106 determines whether the bet time is "0" or not.

In a case in which the CPU 106 determines that the bet time is not "0" (in the case of a NO determination in the processing of Step S12), the CPU 106 advances the processing to Step S13.

On the other hand, in a case in which the CPU 106 determines that the bet time is "0" (in the case of a YES determination in the processing of Step S12), the CPU 106 advances the processing to Step S18 of FIG. 7.

In Step S13, the CPU 106 determines whether the bet screen has been detected being continuously touched by the player.

In a case in which the bet screen has been detected being continuously touched by the player (in the case of a YES determination in Step S13), the CPU 106 advances the processing to Step S14.

On the other hand, in a case in which the bet screen has not been detected being continuously touched by the player (in the case of a NO determination in the processing of Step S13), the CPU 106 advances the processing to Step S12.

In Step S14, the CPU 106 dynamically displays a chip so as to move along the touching path thus detected in the processing in Step S13.

In Step S15, the CPU 106 determines whether the first bet region (either one bet region among a plurality of the bet regions 71 and 72) has been detected being touched by the player.

In a case in which the first bet region has been detected being touched by the player (in the case of a YES determination in Step S15), the CPU 106 advances the processing to Step S16.

On the other hand, in a case in which the first bet region has not been detected being touched by the player (in the case of a NO determination in Step S15), the CPU 106 advances the processing to Step S12.

In Step S16, the CPU 106 displays a chip in the first bet region. In Step S17, the CPU 106 stores in the memory the data indicating that a bet is placed on the first bet region, and advances the processing to Step S18 of FIG. 7.

In Step S18 of FIG. 7, the CPU 106 determines whether the $k^{th}$ (k is a nonnegative integer from 1 to n) bet region (a bet region different from the $k-1^{th}$ bet region among a plurality of bet regions 71 and 72) has been detected being touched by the player.

In a case in which the $k^{th}$ bet region has been detected being touched by the player (in the case of a YES determination in the processing of Step S18), the CPU advances the processing to Step S19.

On the other hand, in a case in which the $k^{th}$ bet region has not been detected being touched by the player (in the case of a NO determination in the processing of Step S18), the CPU 106 ends the bet processing, and advances the processing to Step S6 of FIG. 5.

In Step 19, the CPU 106 determines whether the bet time is "0" or not.

In a case in which the bet time is determined to be not "0" (in the case of a NO determination in the processing of Step S19), the CPU 106 advances the processing to Step S20.

On the other hand, in a case in which the bet time is determined to be "0" (in the case of a YES determination in the processing of Step S19), the CPU 106 returns the processing to Step S6 of FIG. 5.

In Step S20, the CPU 106 determines whether the bet screen has been detected being continuously touched by the player.

In a case in which the bet screen has been detected being continuously touched by the player (in the case of a YES determination in the processing of Step S20), the CPU 106 advances the processing to Step S21.

On the other hand, in a case in which the bet screen has not been detected being continuously touched by the player (in the case of a NO determination in the processing of Step S20), the CPU 106 advances the processing to Step S21.

In Step S21, the CPU 106 dynamically displays a chip so as to move along the touching path thus detected in the processing in Step S20.

In Step S22, the CPU 106 determines whether the $k+1^{th}$ bet region has been detected being touched by the player.

In a case in which the $k+1^{th}$ bet region has been detected being touched by the player (in the case of a YES determination in the processing of Step S22), the CPU 106 advances the processing to Step S23.

On the other hand, in a case in which the $K+1^{th}$ bet region has not been detected being touched by the player (in the case of a NO determination in the processing of Step S22), the CPU 106 advances the processing to Step S19.

In Step S23, the CPU 106 displays a chip in the $k+1^{th}$ bet region.

In Step S24, the CPU 106 stores in the memory the data indicating that a bet has been placed on the $k+1^{th}$ bet region, and ends the bet processing.

FIG. 8 is a flowchart showing the flow of raise processing.

Firstly, the CPU 106 determines whether the player touching the double bet button 81 has been detected (Step S31).

In a case of the player touching the double bet button 81 being detected (in a case of a YES determination in the processing of Step S31), the CPU 106 advances the processing to Step S32.

On the other hand, in a case of the player touching the double bet button 81 not being detected (in a case of a NO determination in the processing in Step S31), the CPU 106 ends raise processing and advances the processing to Step S7 of FIG. 5.

In Step S32, the CPU 106 determines whether a bet time is "0" or not.

In a case of a bet time not being "0" (in a case of a NO determination in the processing in Step S32), the CPU advances the processing to Step S33.

On the other hand, in a case of the bet time being "0" (in a case of a YES determination in the processing in Step S32), the CPU 106 ends raise processing and advances the processing to Step S7 of FIG. 5.

In Step S33, the CPU 106 changes all of the bet amounts stored in the memory to be double with one operation.

Upon ending this processing, the CPU 106 ends raise processing and advances the processing to Step S7 of FIG. 5.

FIGS. 9 to 13 are display examples of a bet screen according to a first embodiment of the present invention.

FIG. 9 is a display example of a bet screen when a player operates the start switch 25 and the liquid crystal display 30 displays a bet screen.

On the liquid crystal display 30, unit bet buttons 76 of a shape similar to that of a chip are displayed.

The bet buttons 76 are composed of a 1 bet button 76A, a 5 bet button 76B, a 10 bet button 76C, and a 100 bet button 76D. On the other hand, a chip is not displayed on the betting board 70.

It should be noted that "30" is displayed on the bet time display unit 74 and "79" is displayed on the credit amount display unit 78.

Then, other than the unit bet button 76, a raise switch, for making all of the chips that have been bet so far to be double, is displayed on the liquid crystal display 30.

Figure 10:
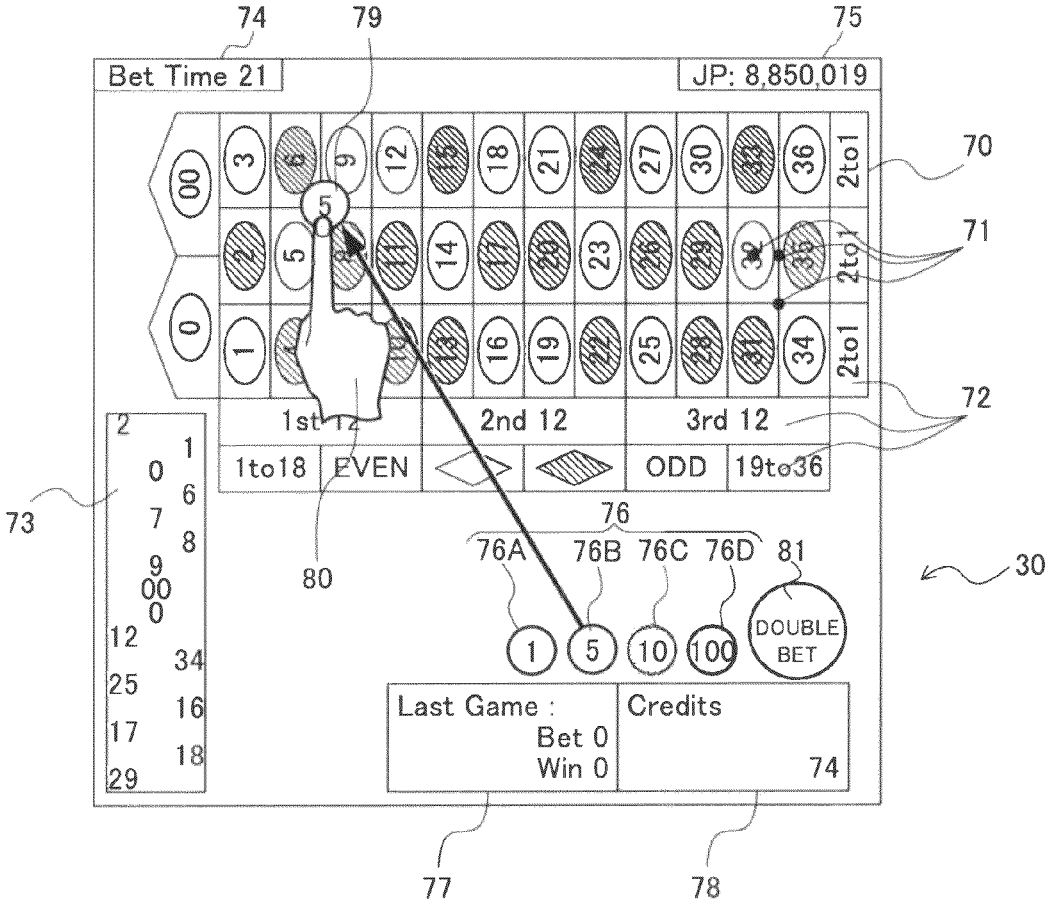

FIG. 10 is a display example of abet screen in which the player then touches the 5 bet button 76B among the unit bet buttons 76 and continuously touches the 5 bet button 76B from the position of the 5 bet button 76B thus touched to the intersection of the lines of the boxes of "5", "6", "8", and "9".

The liquid crystal display 30 dynamically displays a chip 79 so as to move along the touching path thus detected in response to the CPU detecting the touch.

Along with the dynamic display, an image of a hand 80 is displayed below the chip 79.

With such a configuration, a sensation that, for example, a player actually places a bet on 4 numbers "5", "6", "8", and "9" can be obtained.

It should be noted that "21" is displayed on the bet time display unit 74.

Furthermore, in the present game, since a "5" chip is bet, the number displayed on the credit amount display unit 78 decreases from "79" to "74".

Figure 11:
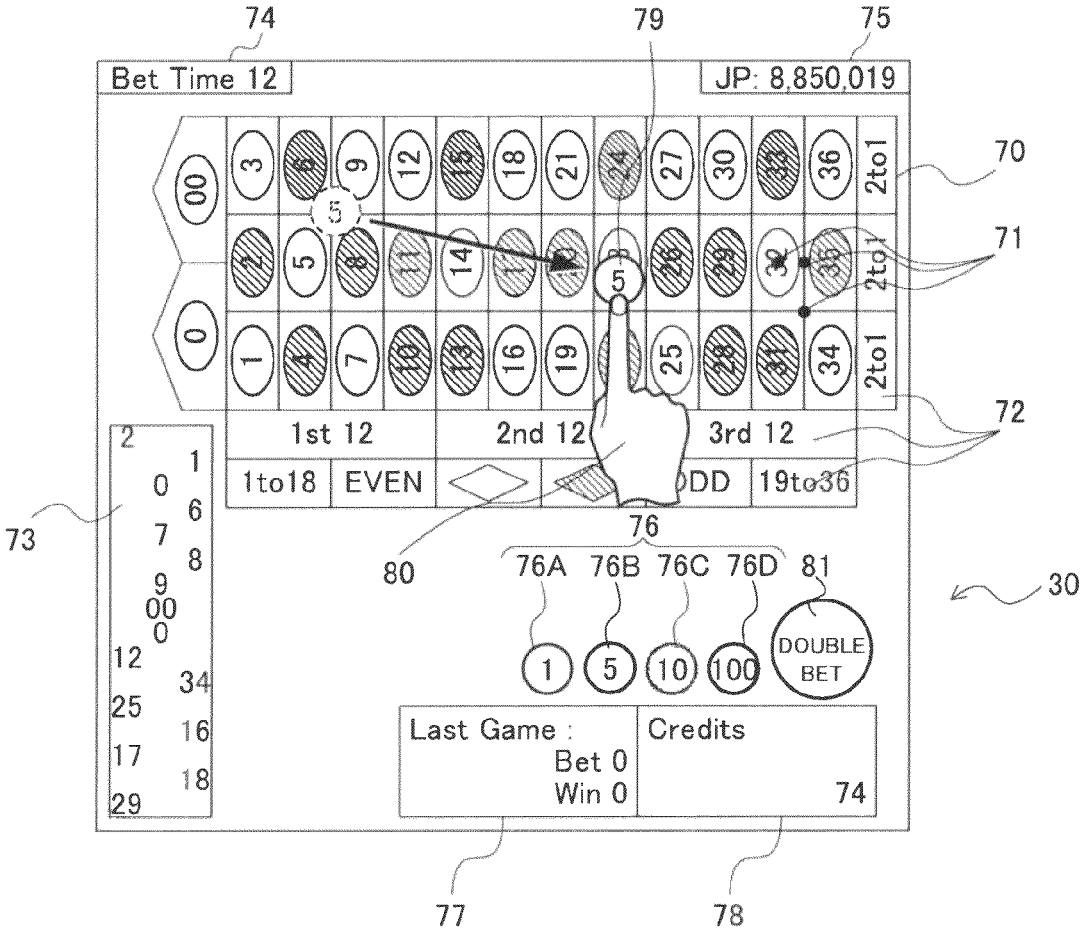

FIG. 11 is a display example of a bet screen in which the player touches the intersection of the lines of the boxes "5", "6", "8", and "9" and continuously touches from the intersection thus touched to the box "23".

The liquid crystal display 30 dynamically displays the chip 79 so as to move along the touching path thus detected in response to the CPU 106 detecting the touch.

Then, the chip 79, which had been displayed on the intersection of the lines of the boxes "5", "6", "8", and "9", becomes hidden. It should be noted that "12" is displayed on the bet time display unit 74.

Figure 12:
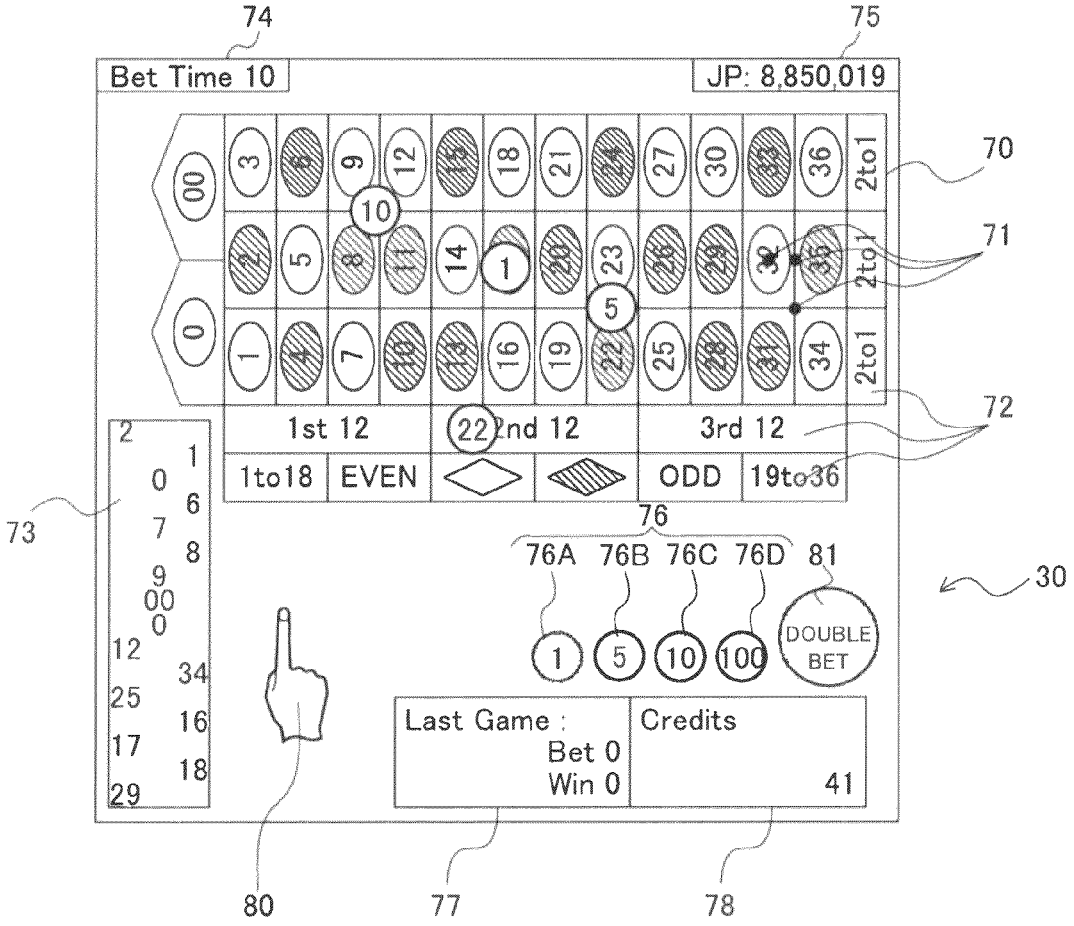

FIG. 12 is a display example of a bet screen during which the operation that is explained with reference to FIGS. 9 to 11 is repeated and a time limit in which betting is possible has 10 seconds remaining. In this display example, "10" is displayed in a bet time display unit 74.

In addition, one chip is placed in the box of "17", five chips are placed between the box of "22" and the box of "23", ten chips are placed on the intersection of the lines of the boxes of "8", "9", "10", and "12", and twenty two chips are placed in the box of "2nd 12".

This time, "41" is displayed on the credit amount display unit 78.

That is, the example in FIG. 12 illustrates that the player Straight-up bets one chip, Split bets five chips, Corner bets ten chips, and Dozen bets twenty-two chips within the time until the remaining time is 10 seconds.

Figure 13:
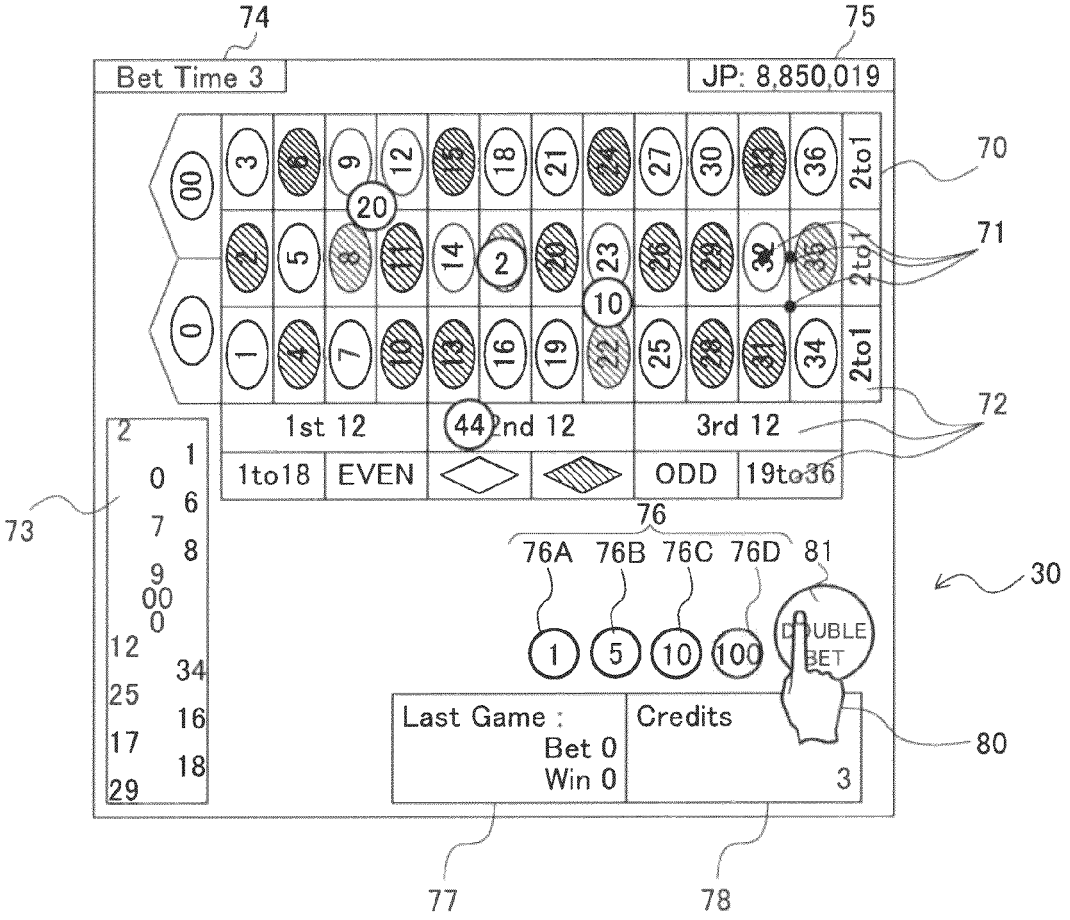

FIG. 13 is a display example of a bet screen in a case in which the player operates the double bet button 81 when the time limit in which betting is possible has three seconds remaining.

In this display example, "3" is displayed in the bet time display unit 74, and all of the values of chips displayed on the bet screen became double.

That is, in the example of FIG. 13, regardless of the remaining time for betting being scarce, the player Straight bets two chips, Split bets ten chips, Corner bets twenty chips, and Dozen bets forty-four chips.

Then, the number displayed on the credit amount display unit 78 decreases from "41" to "3".

In this way, since a plurality of chips can be bet at a plurality of locations by pushing once the double bet button 81, players can develop their strategy immediately before the time limit in which betting is possible ends.

It should be noted that, in the examples of FIGS. 12 and 13, in a case in which the player push the double bet button 81 once, twice, three times, four times . . . , the corresponding amount of chips bet increases four times, eight times, sixteen times.

FIG. 14 is a display example of a roulette game according to an embodiment of the present invention.

The liquid crystal display 30 displays a state in which a ball drops in a roulette device 60 and the roulette device 60 rotates.

With such a configuration, the player can touch the chip displayed in the first bet region (for example, the intersection of the lines of the boxes "5", "6", "8", and "9"), and then move the chip once placed for betting to another bet region by touching the second bet region (for example, the box "23").

Thus, a gaming machine can be provided that overcomes trouble in an operation of moving a chip once bet to another region.

Furthermore, while the timer 113 measures 60 seconds, the player can touch a chip that is presently bet and displayed on a bet region, and then move the chip once placed for betting to another bet region by touching another bet region as many times as the player wants.

Furthermore, there is a difference in that a chip is moved artificially using the cancel button or the like, and an operation to move a chip once placed for betting to another region can be performed as if an actual chip is caused to move.

Thus, a gaming machine which overcomes trouble in an operation of moving a chip once bet to another region can be provided.

Next, a second embodiment of the present invention is explained with reference to the drawings.

The first embodiment was an embodiment in which the CPU 106 displays the double bet button 81 on the liquid crystal display 30, and raise processing is performed by the CPU 106 by the player pressing the double bet button 81.

The second embodiment is an embodiment related to a gaming machine 13 in which the player can easily raise chips without the double bet button 81 being provided.

Here, configurations common with the first embodiment are omitted, and only configurations unique to the second embodiment are explained.

The gaming machine 13 according to the present invention includes a liquid crystal display 30 that displays game results; a betting board 70 that has a plurality of bet regions 71 and 72, and allows for different bet amounts to be bet on a plurality of bet regions in one game; a input device that allows a plurality of locations of the plurality of bet regions 71 and 72 on the betting board 70 to be designated, and allows for the bet amounts on the plurality of bet regions thus designated to be input at different bet amounts on each bet region thus designated (e.g., touch panel 32, unit bet button 76); RAM 110 in which each bet amount of the plurality of bet regions thus designated by way of the input device is stored; a timer 113 for measuring a bet time in which the input device and the raise switch can be operated; and a CPU 106 that executes subsequent bet processing and raise processing.

Figure 15:
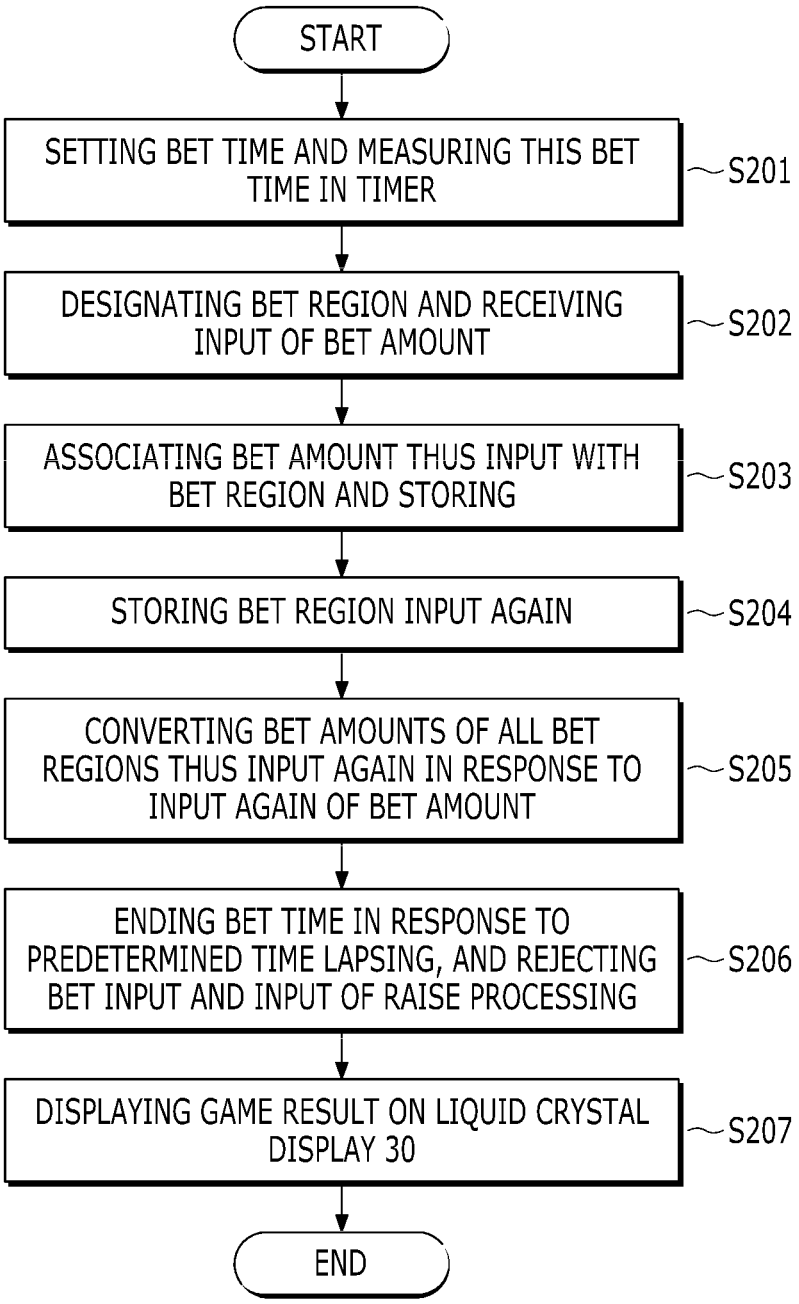
FIG. 15 is a flowchart schematically showing bet processing and raise processing, which are executed in a gaming machine according to the second embodiment of the present invention.

As shown in FIG. 15, the CPU 106 sets a bet time according to the start of a game, and measures this bet time in the timer 113 (Step S201).

Then, the CPU 106 designates at least one bet region from among the plurality of bet regions 71 and 72 displayed on the betting board 70, and receives an input of a bet amount on each of the at least one bet regions by way of operation of the input device (Step S202).

Then, the CPU 106 associates a bet amount thus input by way of the input device with each of the at least one bet regions thus designated, and stores in the memory (RAM 110) (Step S203).

Then, the CPU 106 stores a bet region that the player inputs again in the RAM 110 (Step S204).

Then, in response to the player having input a bet amount again, the CPU 106 simultaneously converts, with one operation, the bet amounts of all of the bet regions thus input again in the processing of Step 5204 (Step S205).

Then, the CPU 106 ends the bet time in response to the time measured by the timer 113 passing a time set in advance (e.g., 30 seconds), and rejects bet input by way of the input device and input of the double bet button 81 (Step S206).

Then, the CPU 106 displays a game result on the liquid crystal display 30 (Step S207).

The CPU 106 ends bet processing and raise processing in response to the processing of Step S106.

The structure of the gaming machine 13 is as shown in FIG. 2.

In addition, the electrical configuration of the game controller 100 of the gaming machine 13 is as shown in FIG. 3, and electrical configuration of the display/input controller 140 of the gaming machine 13 is as shown in FIG. 4.

Figure 16:
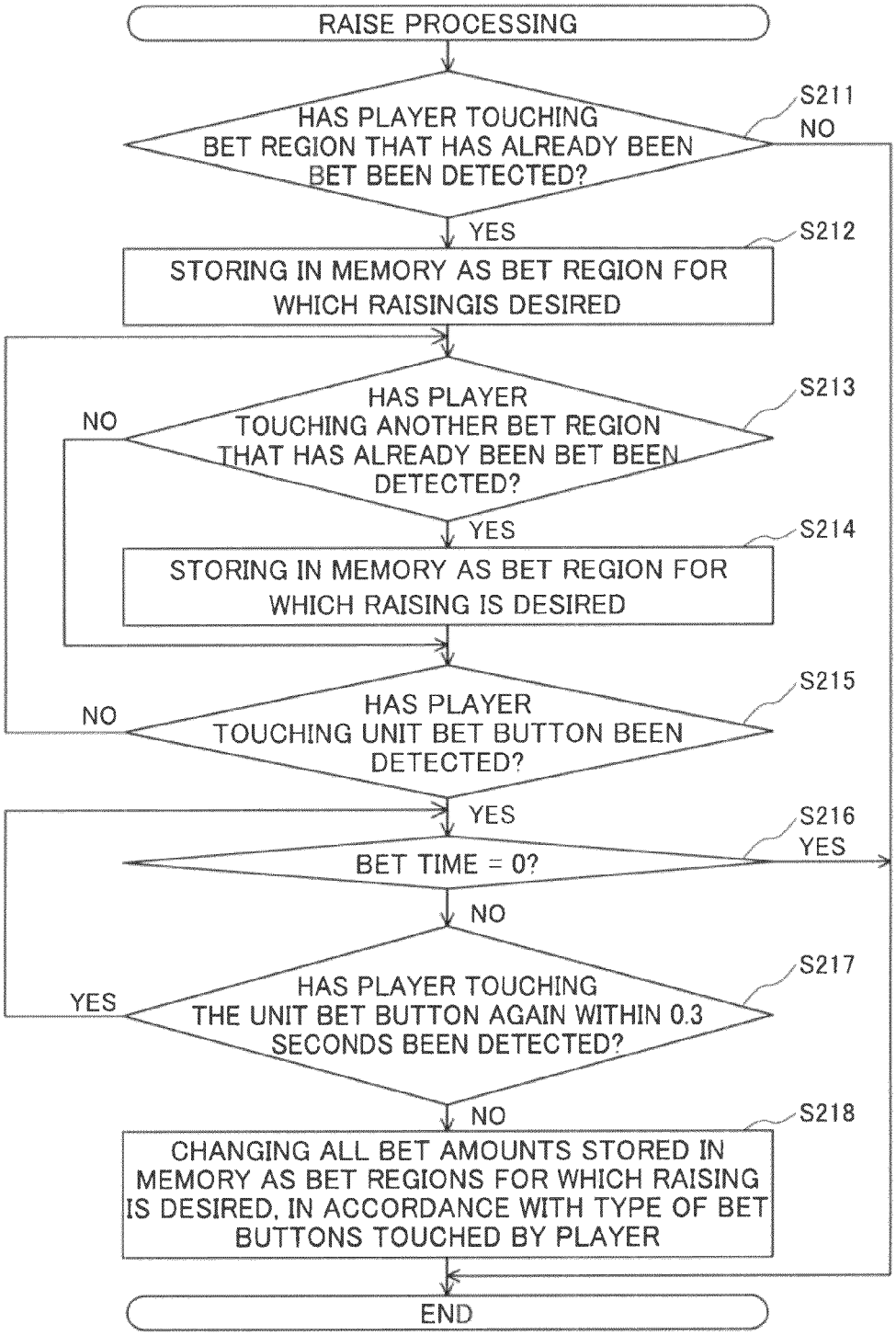
FIG. 16 is a flowchart of raise processing, which is one of the routine execution programs executed in a gaming machine according to the second embodiment of the present invention.
Figure 17:
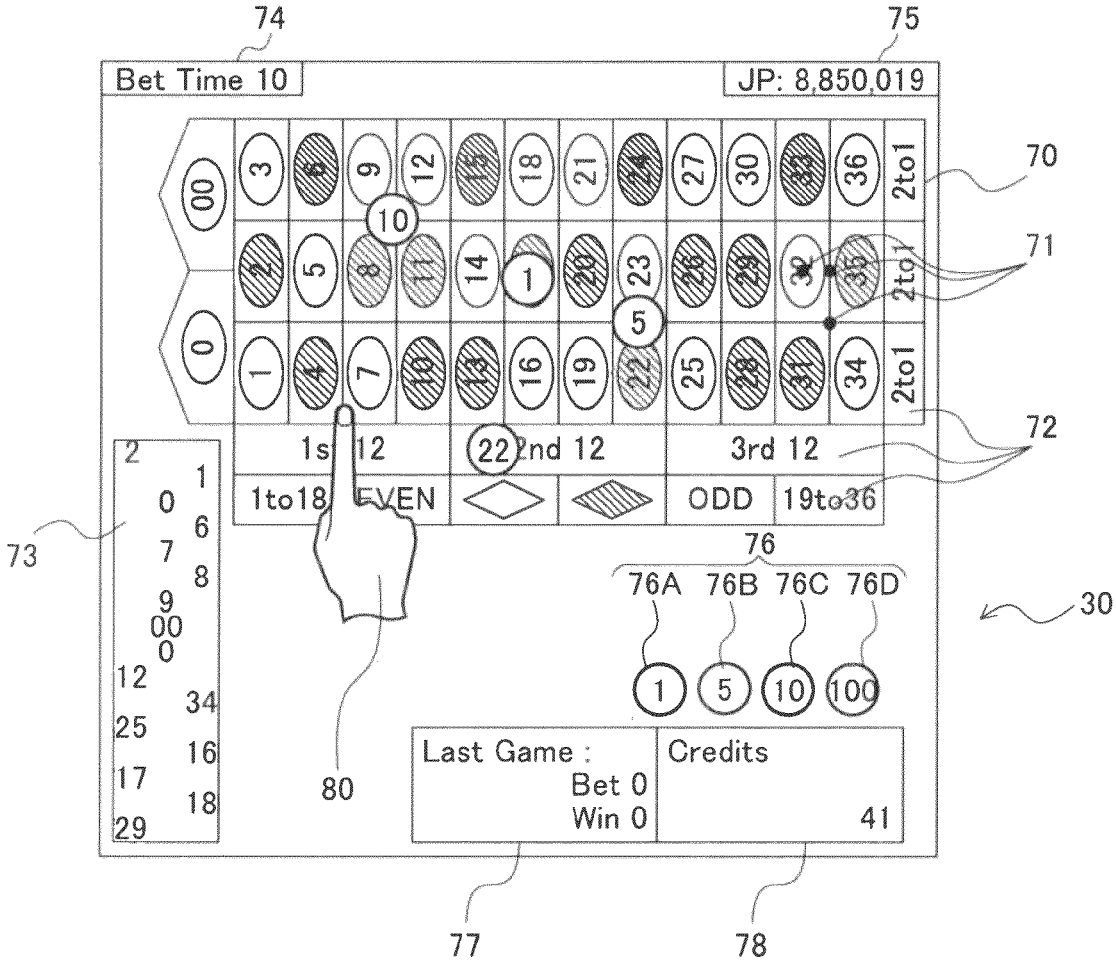
FIGS. 17 to 20 are diagrams showing an example of a bet screen displayed in a gaming machine according to the second embodiment of the present invention.

Then, the flow of processing actions in the gaming machine 13 are as shown in FIG. 5, and the flow of bet processing is as shown in FIGS. 16 and 17, both being executed by the game controller 100 of the gaming machine 13.

FIG. 16 is a flowchart showing the flow of raise processing.

First, the CPU 106 determines whether the player touching a bet region that has already been bet on is detected (Step S211).

In the case of the player touching a bet region that has already been bet on being detected (in the case of a YES determination in the processing of Step S211), the CPU 106 advances the processing to Step S212.

On the other hand, in a case of the player touching a bet region that has already been bet on not being detected (in the case of a NO determination in the processing of Step S211), the CPU 106 ends raise processing, and advances to the processing of Step S7 of FIG. 5.

In Step S212, the CPU 106 stores the bet region touched by the player in the memory as a bet region for which raising is desired, and advances to Step S213.

In Step S213, the CPU 106 determines whether the player has touched another bet region that is different from the bet region the player touched in the processing of Step S211, from among the bet regions previously bet.

In the case of the player touching another bet region being detected (in the case of a YES determination in the processing of Step S213), the CPU 106 advances the processing to Step S214.

On the other hand, in the case of the player touching another bet region not being detected (in the case of a NO determination in the processing of Step S213), the CPU 106 advances the processing to Step S215.

In Step S214, the CPU 106 stores the other bet region touched by the player in the memory as a bet region for which raising is desired, and advances to Step S215.

In Step S215, the CPU 106 determines whether the player touching the unit bet button 76 has been detected.

In the case of the player touching the unit bet button 76 being detected (in the case of a YES determination in the processing of Step S215), the CPU 106 advances the processing to Step S216.

On the other hand, in the case of the player touching the unit bet button 76 not being detected (in the case of a NO determination in the processing of Step S215), the CPU 106 advances the processing to Step S213.

In Step S216, the CPU 106 determines whether the bet time is "0".

In the case of determining that the bet time is not "0" (in the case of a NO determination in the processing of Step S216), the CPU 106 advances the processing to Step S217.

On the other hand, in the case of determining that the bet time is "0" (in the case of a YES determination in the processing of Step S216), the CPU 106 ends the raise processing, and advances to the processing of Step S7 of FIG. 5.

In Step S217, the CPU 106 determines whether the player has continuously touched the unit bet button 76.

More specifically, the CPU 106 determines whether the player has touched the unit bet button 76 again within 0.3 seconds.

In the case of the player touching the unit bet button 76 again within 0.3 seconds being detected (in the case of a YES determination in the processing of Step S217), the CPU 106 advances the processing to Step S216.

On the other hand, in the case of the player touching the unit bet button 76 again within 0.3 seconds not being detected (in the case of a NO determination in the processing of Step S217), the CPU 106 advances the processing to Step S218.

In Step S218, the CPU 106 changes all of the bet amounts stored in the memory as the bet regions for which raising is desired, in accordance with the type of unit bet button 76 touched by the player.

When this processing ends, the CPU 106 ends raise processing, and advances the processing to Step S7 of FIG. 5.

FIGS. 17 to 20 are display examples of a bet screen according to the second embodiment of the present invention.

FIG. 17 is a display example of the bet screen when the operation explained with reference to FIGS. 9 to 11 is repeated, and the time limit in which betting is possible has 10 seconds remaining.

When comparing with the display example shown in FIG. 12, in the display example shown in FIG. 17, the aspect of the double bet button 81 not being displayed differs from the double bet button 81 being displayed in the display example shown in FIG. 12.

As explained while referring to FIG. 12, in the display example of FIG. 17, one chip is placed in the box of "17", five chips are placed between the box of "22" and the box of "23", ten chips are placed on the intersection of boxes "8", "9", "11", and "12", and twenty-two chips are placed on the box of "2nd 12".

In other words, in the example of FIG. 17, the player Stand bets one chip, Split bets five chips, Corner bets ten chips, and Dozen bets twenty-two chips within the time until the remaining time is 10 seconds.

FIG. 18 is a display example of a bet screen when the player has touched again any of the plurality of bet regions that has been bet on already.

In this display example, the player touches the intersection of the boxes of "8", "9", "11", and "12" again among the plurality of bet regions that has been bet on already.

At this time, the ten chips that have been placed on the intersection of the boxes of "8", "9", "11", and "12" flash.

In this way, it is implied that the intersection of the boxes of "8", "9", "11" and "12" is a bet region for which raising is desired.

Figure 19:
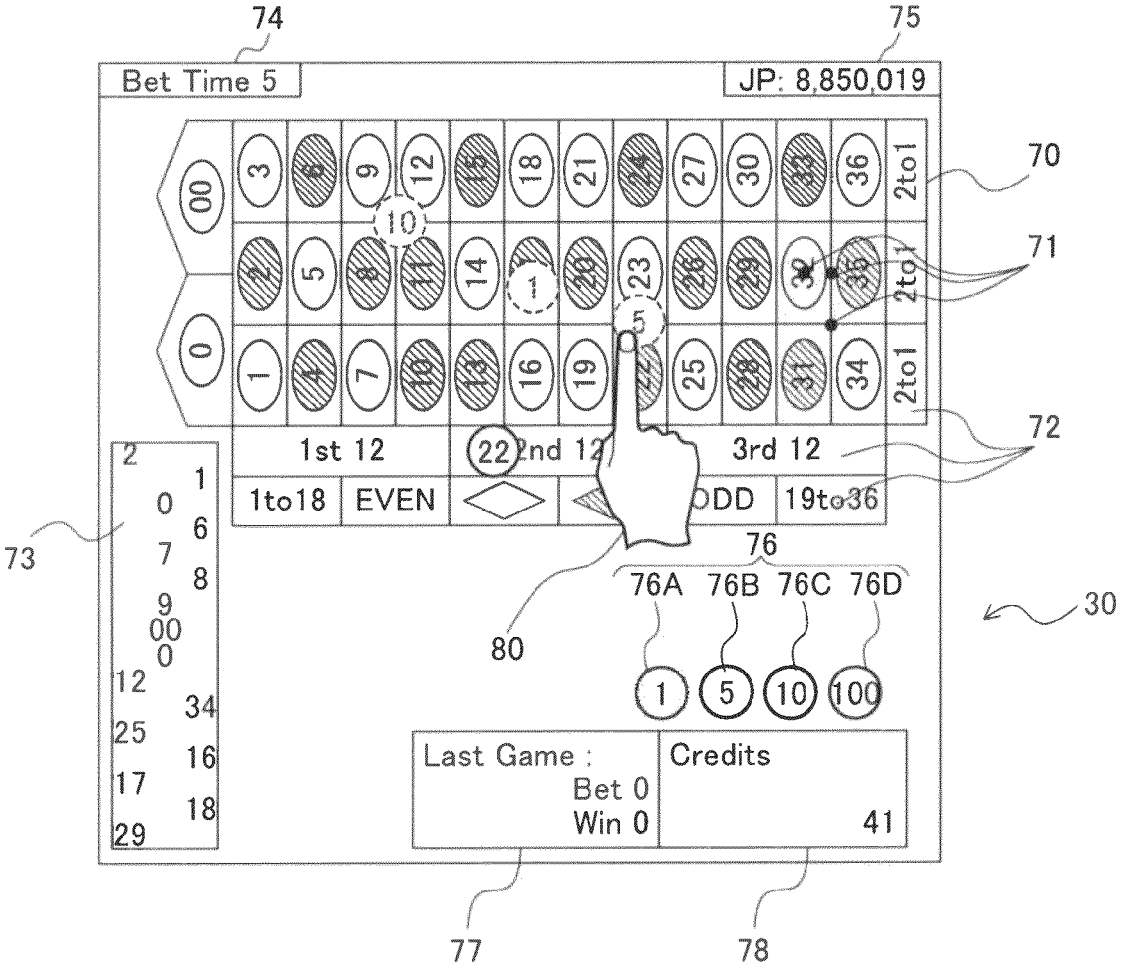

FIG. 19 is a display example of a bet screen when the player has touched again another bet region different from the bet region the player touched again in the display example of FIG. 18, among the plurality of bet regions that has been bet on already.

In this display example, in addition to the intersection of the boxes of "8", "9", "11" and "12", the player touches the box of "17" and between the box of "22" and the box of "23" again, among the plurality of bet regions that has been bet on already.

At this time, in addition to the ten chips having been placed on the intersection of the boxes of "8", "9", "11" and "12", the one chip placed on the box of "17" and the five chips placed between the box of "22" and the box of "23" also flash.

In this way, it is implied that (i) the intersection of the boxes of "8", "9", "11" and "12", (ii) the box of "17", and (iii) between the box of "22" and the box of "23" are bet regions for which raising is desired.

Figure 20:
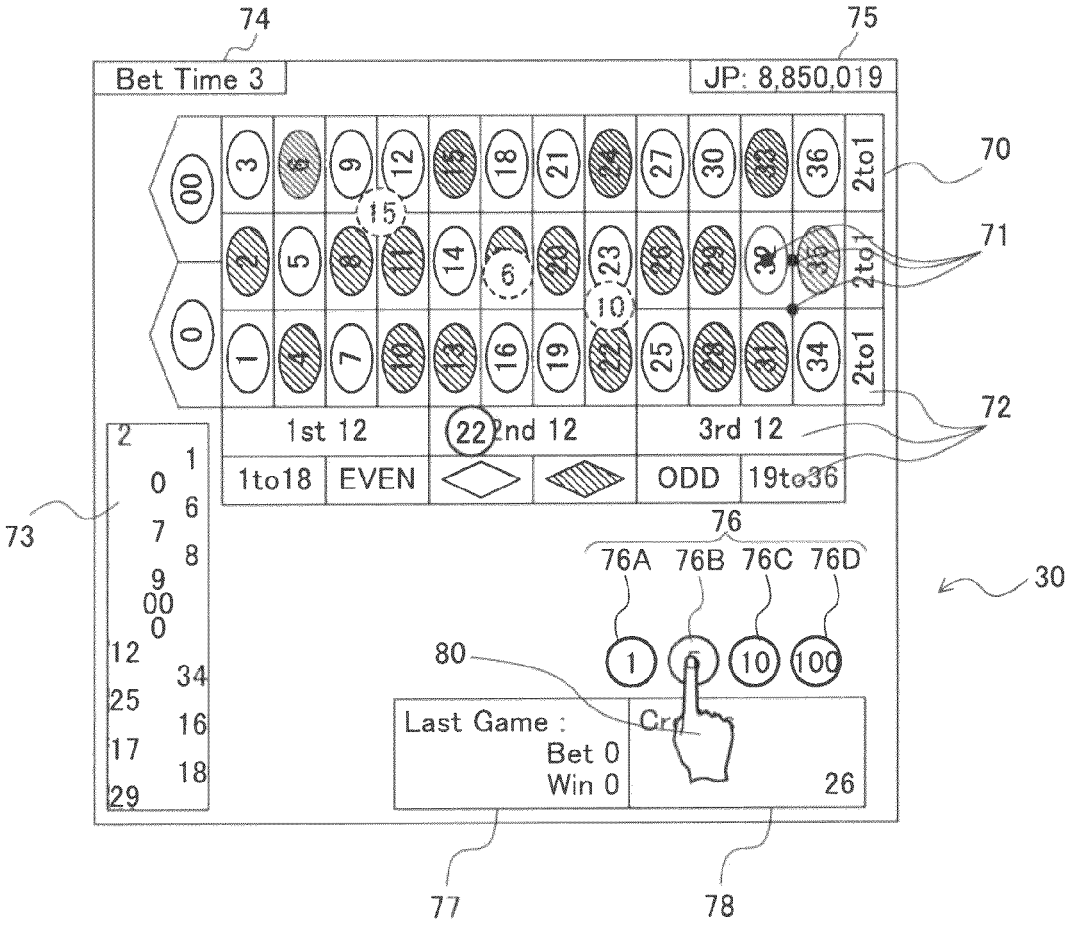

FIG. 20 is a display example of a bet screen when the play has operated the unit bet button 76 when the time limit in which betting is possible has 3 seconds remaining.

Here, a case in which the unit bet button 76 operated by the player is the 5-bet button 76B is explained.

In this display example, "3" is displayed on the bet time display unit 74, while 5 is added to each value of chips having been bet on the plurality of bet regions (i.e. (i) the intersection of the boxes of "8", "9", "11" and "12", (ii) the box of "17", and (iii) between the box of "22" and the box of "23" designated by the player.

In other words, in the example of FIG. 20, the player stand bets six chips, split bets ten chips, corner bets fifteen chips, and dozen bets twenty-two chips, despite the remaining time in which betting is possible short.

Then, digits of the credit amount display unit 78 decrease from "41" to "26".

By configuring in such a way, it becomes possible to make many bets quickly on a plurality of bet regions, since the unit bet button 76 can be operated continuously for a short time period after a bet region has been designated, and the unit bet button 76 can be further operated continuously for a short time period after another bet region has been designated.

In this way, it is configured that a numeral value according to the number of times of inputting the unit bet button 76 is associated with each of the bet regions, as a bet amount, and is stored in the RAM 110 as the memory.

Therefore, it becomes possible to place many bets by way of simple operations such as repeatedly designating a bet region in which a bet is desired and pushing the unit bet button 76 as a button switch as many times as a player desires to bet.

Descriptions regarding the first and second embodiments have been provided above.

Although the first and second embodiments of the present invention are explained as embodiments that are different from each other, they may be one embodiment combining both the embodiments.

That is, it may be configured that the double bet button 81 is displayed on the liquid crystal display 30 as shown in the first embodiment, while re-designation of a bet region and a re-operation of the unit bet button 76 can be performed as shown in the second embodiment.

Figure 21:
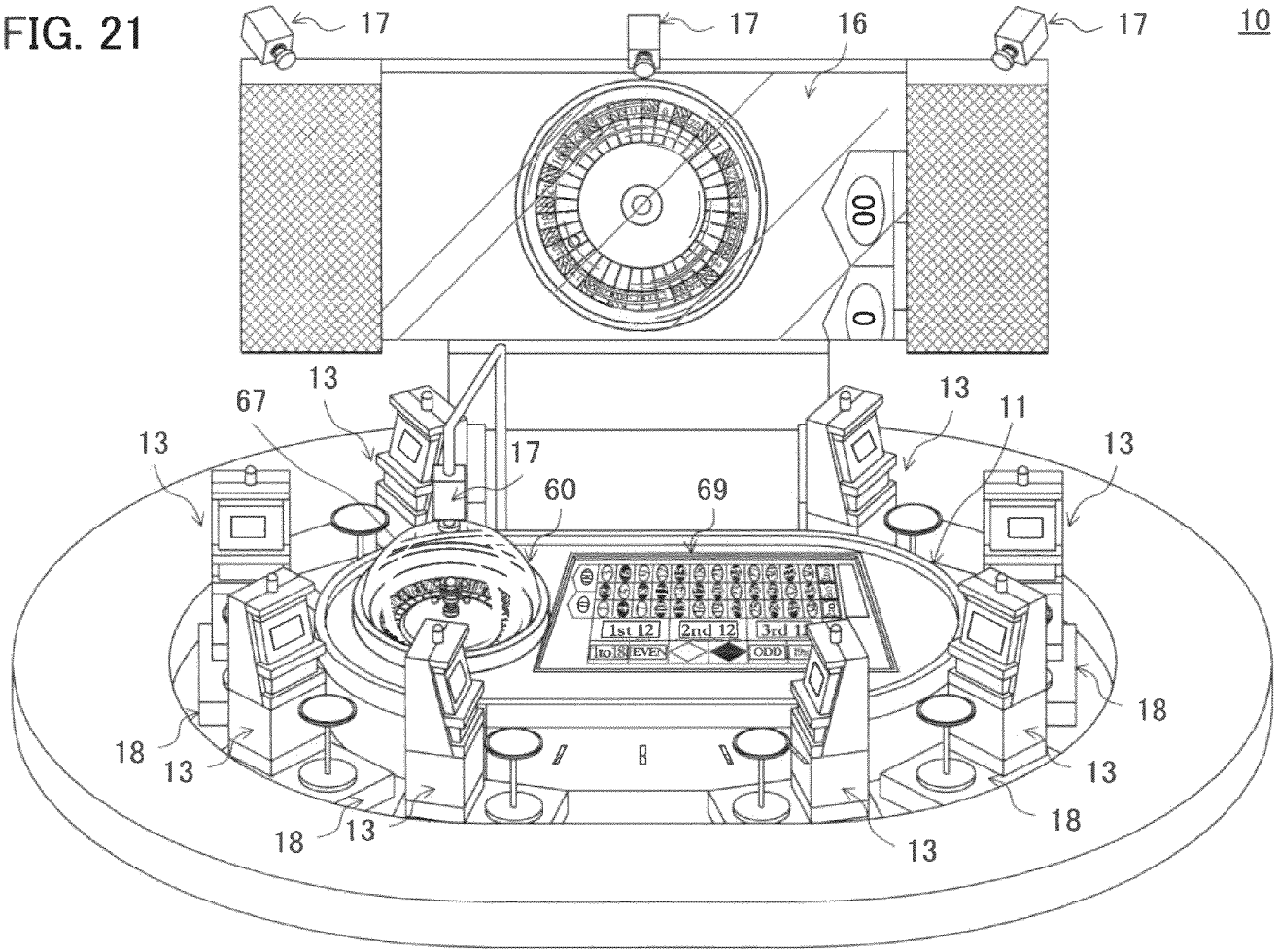
FIG. 21 is a schematic diagram showing an outer appearance of a game system configured to include gaming machines according to a modified example of the present invention.

In the first and second embodiments of the present invention, although a roulette game is described as being progressed using a single gaming machine 13, as shown in FIG. 21, a roulette game may be progressed as a mass game using a plurality of the gaming machines 13.

A description is provided with respect to FIG. 21. FIG. 21 is a perspective diagram showing an outer appearance of a gaming system 10 using a plurality of the gaming machine 13.

As shown in FIG. 21, the gaming system 10 includes a plurality of the gaming machines 13 and a roulette game device 11.

Furthermore, a configuration may be made so that the gaming system 10 includes a large-size monitor 16, and displays contents of the display 69 that displays a large-size betting board indicating a condition of betting of a plurality of players, abet time indicating a remaining time in which betting is possible, winning numbers, etc. as a progress state of the roulette game on the monitor 16, along with displaying an image of the roulette wheel rotating or a picture of a player captured by the moveable viewpoint camera described later when necessary.

A plurality of the gaming machines 13 (eight gaming machines in the present embodiment) are provided so as to allow players to see the monitor 16.

In addition, each gaming machine 13 and a seat 57 thereof for the player is installed on a movable floor 18, and upon a roulette game starting, a gaming machine 13 that has entered the roulette game is configured so as to be raised as one unit with the seat 57 thereof along with raising the movable floor 18.

Furthermore, the gaming system 10 includes a plurality of movable viewpoint cameras 17 (four in the present embodiment). One of the movable viewpoint cameras 17 is provided for capturing an image of a roulette device 60 described later, and captures and displayed on the monitor 16 an image of the rotating roulette wheel, and an image of a ball 65 at a certain position after the roulette wheel stops.

The movable viewpoint camera 17 for capturing an image of the roulette device 60 is provided at a position that allows it to capture an image of the roulette device 60 from the viewpoint along the vertical direction from the upper side to the lower side of the roulette device 60.

The movable viewpoint camera 17 for capturing an image of the roulette device 60 may capture other images before the rotation of the roulette wheel, e.g., an image of the players or an image of the display 69 for displaying the large-size betting board.

The other movable viewpoint cameras 17 are installed on the upper end of the monitor 16 so as to capture a player's facial expressions.

The images captured by the movable viewpoint cameras 17 are displayed on a liquid crystal display 30 of the gaming machine 13 in addition to the large-size monitor 16.

In the first and second embodiments of the present invention, although it is configured so that abet is placed by way of a moving operation of a finger using a touch panel even when betting a chip using the unit bet button 76, the present invention is not limited thereto.

The present invention is an invention related to moving a chip once bet on the bet region 71 or 72 to another bet region, and the method whereby the initially is placed on the bet region 71 or 72 may be any kind of method.

For example, a configuration may be made so that the player first designates the bet regions 71 or 72 to be bet on by directly pushing the screen with a finger or the like and, while in this state, bets chips in increments of one (the amount of chips bet is incremented in the order of "1", "2", "3", . . . , for each time the player presses the 1 bet button 76A with a finger or the like) by pressing the 1 bet button 76A.

Such a configuration simplifies the operation, even when betting a great amount of chips.

Furthermore, in the first and second embodiments of the present invention, although a configuration is made so that a bet is performed only by touching a chip by a player, the present invention is not limited thereto.

Figure 22:
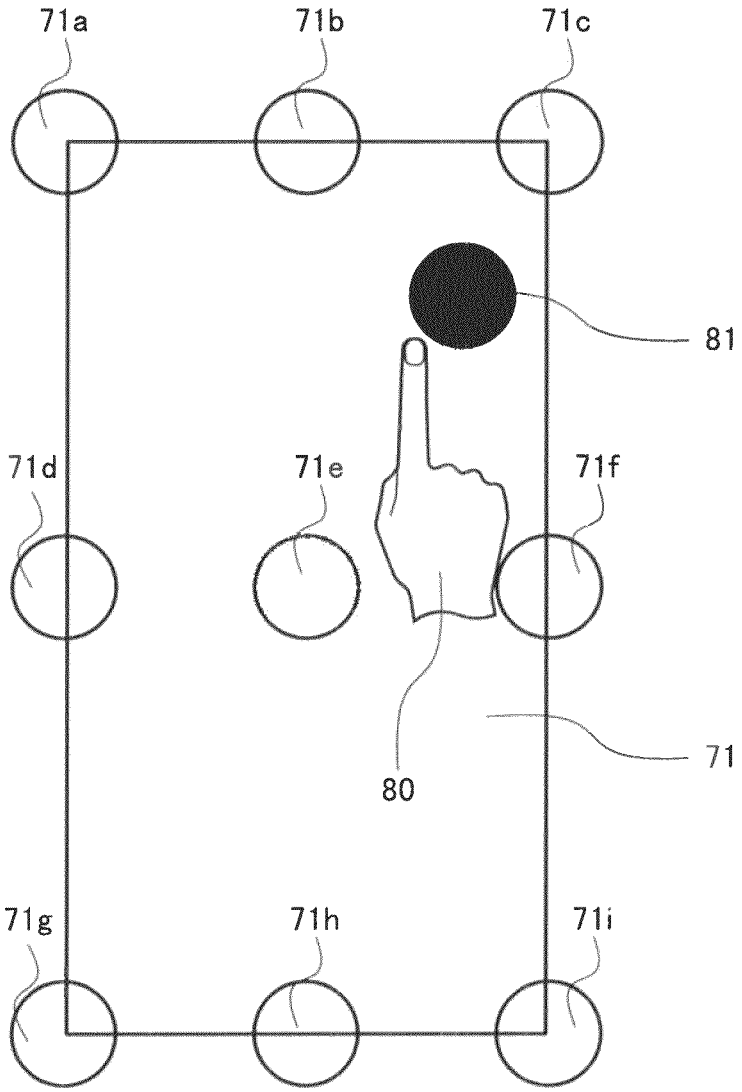
FIGS. 22 to 25 show examples of a bet screen displayed on a gaming machine according to a modified example of the present invention.

For example, as shown in FIG. 22, the bet region 71 as a single box is composed of nine bet regions 71*a* to 71*i*.

Figure 23:
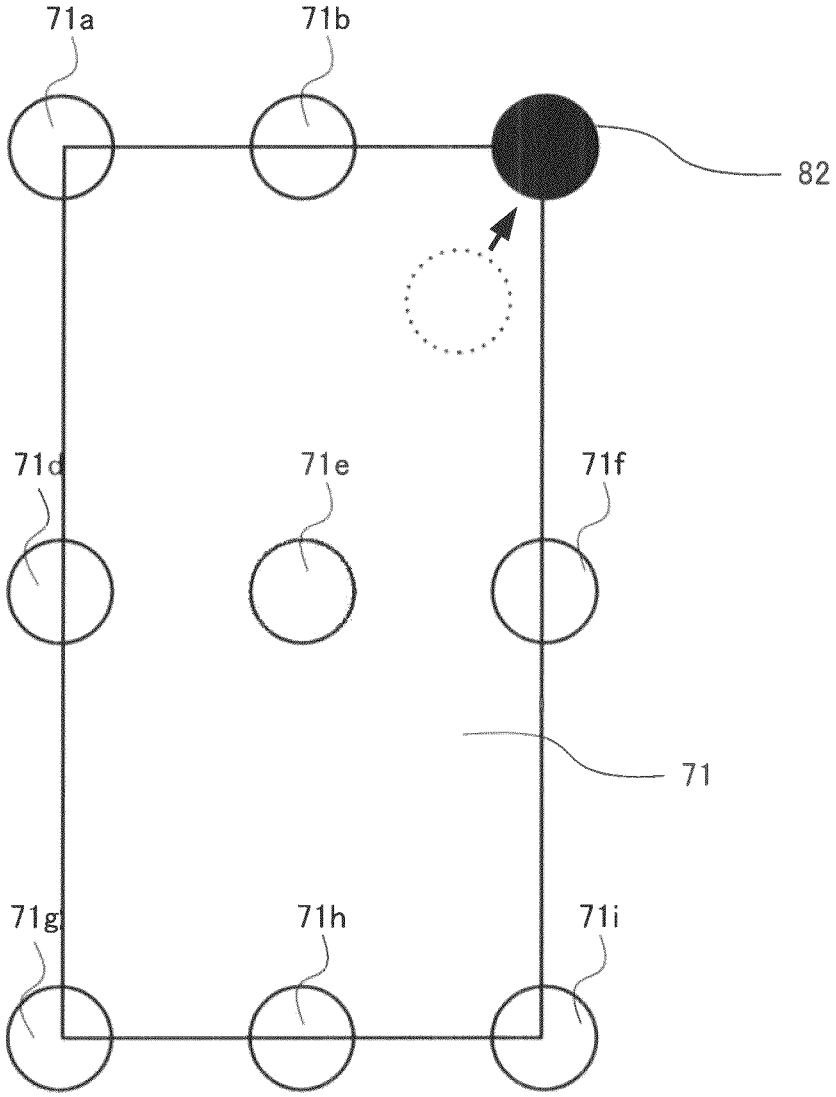

It may be configured such that, in a case in which a chip 82 is moved to a position different from the positions of these nine bet regions 71*a* to 71*i*, as shown in FIG. 23, a chip 82 is moved from a position of the chip 82 thus moved to the bet region 71*c* which is the nearest thereto, without being influenced by a player's operation.

Thus, the chip can be bet on a position intended by the player even without the chip being moved to an exact position.

In FIGS. 10 to 13 and 17 to 20, although the types of chips bet and locations of the chips bet are displayed in the liquid crystal display 30, the present invention is not limited thereto.

Figure 24:
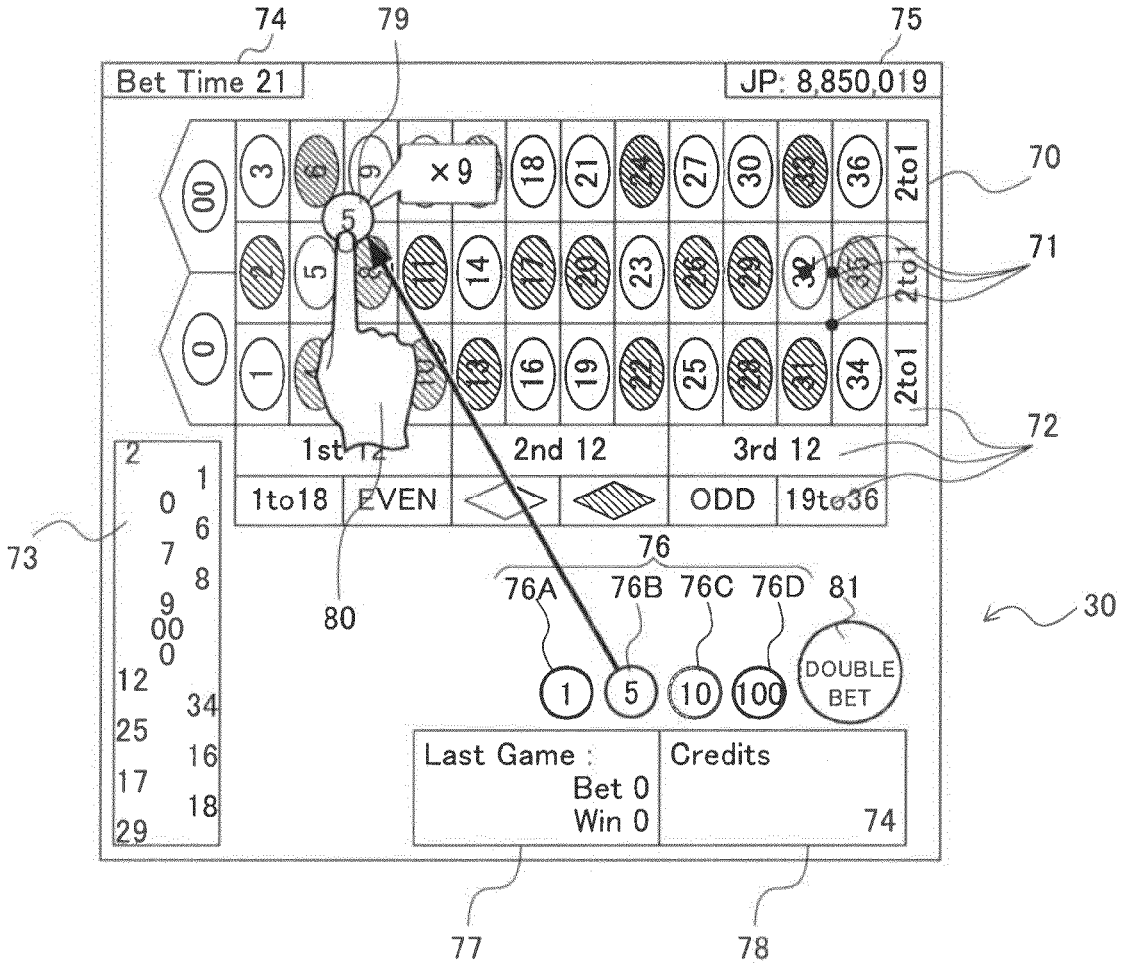
Figure 25:
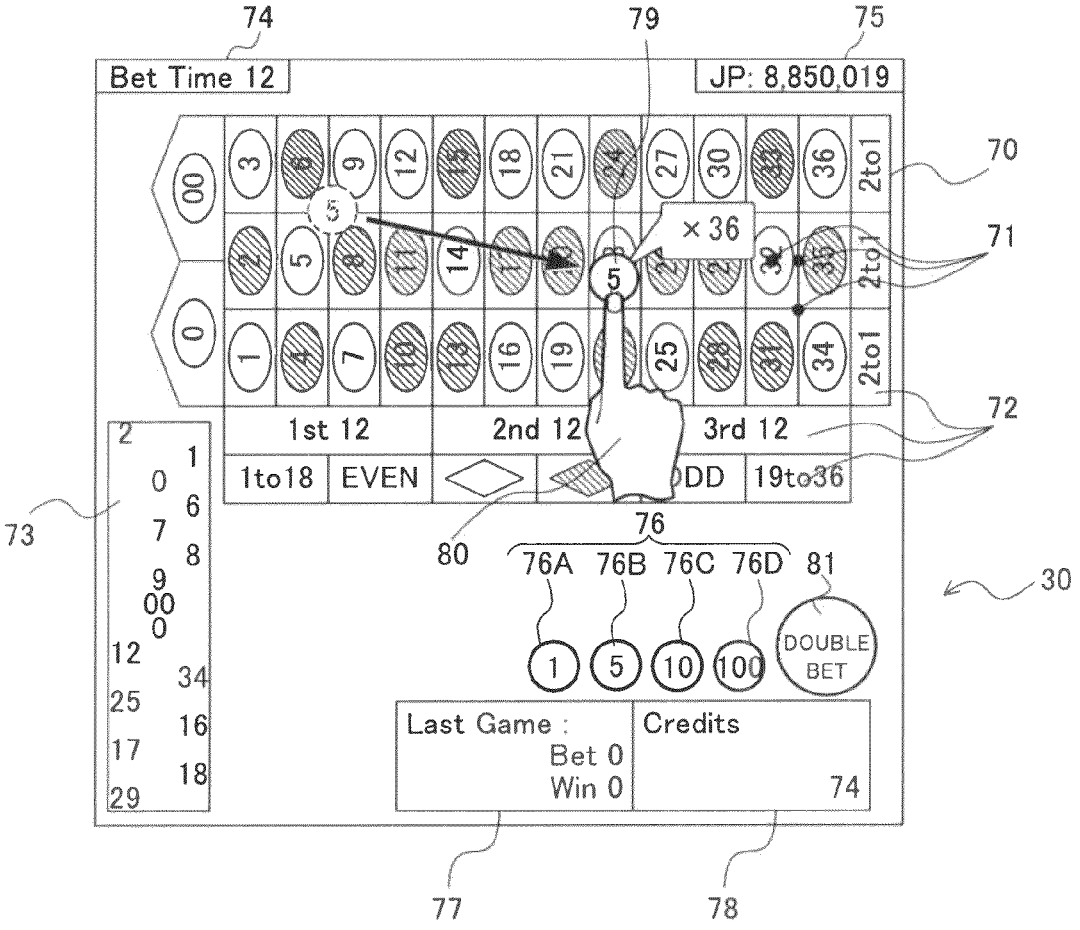

For example, as shown in FIGS. 24 and 25, in addition to displaying the types of chips and the locations of the chips bet, awards of a location to which chips have been moved may be displayed together on the display in a popup manner.

FIG. 24 corresponds to the abovementioned FIG. 10 and is a display example of a bet screen in which the player touches the 5 bet button 76B among the unit bet buttons 76 and continues to touch the 5 bet button 76B from the position of the 5 bet button 76B thus touched to the intersection of the lines of the boxes "5", "6", "8", and "9".

In this case, since the chip is bet on 4 numbers, the award for it is 4/36, which is 9 to 1.

Therefore, the number "x 9" pops up on the chip thus bet.

FIG. 25 corresponds to the abovementioned FIG. 11 and is a display example of a bet screen when the player touches the 5 bet button 76B among the unit bet buttons 76, and the player continuously touches the 5 bet button 76B from the position of the 5 bet button 76B thus touched to the box "23".

In this case, since the chip is bet on a single number, the award for it is 1/36, which is 36 to 1.

Therefore, the number "x 36" pops up on the chip thus bet.

Thus, when the player moves a chip to an arbitrary bet location, the player can visually recognize an award thereof immediately.

While moving a chip, the player can always recognize the amount of an award that can be won.

Although embodiments of the present invention are described above, they are merely exemplified specific examples, and the present invention is not particularly limited thereto. Specific configurations such as each means can be modified appropriately.

Moreover, it should be understood that the advantages described in association with the embodiments of the present invention are merely a listing of most preferred advantages realized by the present invention, and that the advantages according to the present invention are by no means restricted to those described in connection with the embodiments.

What is claimed is:

1. A gaming machine comprising:

a display to display a game result;

a betting board that has a plurality of bet regions corresponding to a plurality of types of the game results, and allows betting different bet amounts on a plurality of the bet regions in one game;

an input device to receive a designation of a plurality of locations of the plurality of bet regions on the betting board, and allow a bet amount related to the plurality of bet regions thus designated to be input at a different bet amount for each of the bet regions thus designated;

a memory to store each of the bet amounts on the plurality of bet regions designated by way of the input device;

a raise switch to raise a bet amount previously bet on each of the plurality of bet regions at a predetermined multiple;

a timer to measure a bet time in which the input device and the raise switch can be operated; and a controller to:

(a) set a bet time according to a start of a game, and measure the bet time in the timer;

(b) designate two or more bet regions from among the plurality of bet regions on the betting board, and receive input of a bet amount on each of the two or more bet regions by way of an operation of the input device;

(c) associate the bet amount input by way of the input device respectively with the two or more bet regions designated, and store thereof in the memory;

(d) convert all of the bet amounts associated with the two or more bet regions stored in the memory to a predetermined multiple simultaneously in response to an input of the raise switch;

(e) end the bet time in response to a time measured by the timer having passed a time set in advance, and reject a bet input by way of the input device and an input of the raise processing by way of the raise switch; and (f) display a game result on the display after the bet time has ended, wherein the plurality of bet regions include a plurality of first bet regions, a plurality of second bet regions, and a plurality of third bet regions, each of the first bet regions corresponds to one numeral, each of the second bet regions corresponds to two numerals, and each of the third bet region corresponds to four numerals, and when the chip is moved to a certain position that is different from positions of the plurality of bet regions in (b), the controller moves the chip from the certain position to a position that is the closest to the certain position among the positions of the plurality of bet regions; and wherein in (b), each of the at least one bet region is designated by a chip corresponding to the bet amount which is moved by way of the operation, and when each of the two or more bet regions is designated in (b), the controller displays the chip on the designated bet region and displays on the chip a payout rate corresponding to the designated bet region.

2. The gaming machine of claim 1, wherein, in (b), the controller designates each of the bet regions and receives the input of the bet amount on each of the bet regions when detecting that a player continuously touches a chip corresponding to the bet amount on each of the bet regions at a chip position to each of the bet regions along a touching path in the input device.

3. The game machine of claim 1, wherein the controller displays, as a popup on the chip, the payout rate corresponding to the designated bet region.

4. A gaming machine comprising:

a display to display a game result;

a betting board that has a plurality of bet regions corresponding to a plurality of types of the game results, and allows betting different bet amounts on a plurality of the bet regions in one game;

an input device to receive a designation of a plurality of locations of the plurality of bet regions on the betting board, and allow a bet amount related to the plurality of bet regions thus designated to be input at a different bet amount for each of the bet regions thus designated;

a memory to store each of the bet amounts on the plurality of bet regions designated by way of the input device; a timer for measuring a bet time in which the input device can be operated; and a controller to:

(a) set a bet time according to start of a game, and measure the bet time in the timer;

(b) designate at least one bet region from among the plurality of bet regions on the betting board, and receive input of a bet amount on each of the at least one bet region by way of an operation of the input device;

(c) associate the bet amount input by way of the input device respectively with the at least one first bet region designated, and store thereof in the memory;

(d) re-designate at least one second bet region among the least one first bet region stored in the memory;

(e) perform raise processing for the bet amounts associated with the at least one second bet region re-designated in response to re-input on the input device, and update the bet amounts at least one second bet region re-designated;

(f) end the bet time in response to a time measured by the timer having passed a time set in advance, and reject a bet input by way of the input device; and (g) display a game result on the display after the bet time has ended, wherein the at least one second bet region re-designated includes two or more re-designated bet regions, and in (e), all of the bet amounts of the two or more re-designated bet regions are simultaneously updated in response to the re-input on the input device, and wherein the plurality of bet regions include a plurality of first bet regions, a plurality of second bet regions, and a plurality of third bet regions, each of the first bet regions corresponds to one numeral, each of the second bet regions corresponds to two numerals, and each of the third bet region corresponds to four numerals, and when the chip is moved to a certain position that is different from positions of the plurality of bet regions in (b), the controller moves the chip from the certain position to a position that is the closest to the certain position among the positions of the plurality of bet regions;

wherein in (b), each of the at least one bet region is designated by a chip corresponding to the bet amount which is moved by way of the operation, and when each of the at least one bet region is designated by the chip in (b), the controller displays the chip on the designated bet region and displays on the chip a payout rate corresponding to the designated bet region.

5. The gaming machine of claim 4, wherein, in (b), the controller designates each of the bet regions and receives the input of the bet amount on each of the bet regions when detecting that a player continuously touches a chip corresponding to the bet amount on each of the bet regions at a chip position to each of the bet regions along a touching path in the input device.

6. The game machine of claim 4, wherein the controller displays, as a popup on the chip, the payout rate corresponding to the designated bet region.

* * * * *